US011583018B2

(12) United States Patent
Dey et al.

(10) Patent No.: US 11,583,018 B2
(45) Date of Patent: Feb. 21, 2023

(54) MILANESE BAND

(71) Applicant: Apple Inc., Cupertino, CA (US)

(72) Inventors: Stephen E. Dey, San Francisco, CA (US); Xingyu Wan, Anshan (CN); Justin T. Sawyer, San Jose, CA (US); Matthew N. Van Dyke, San Francisco, CA (US); Hsiang Hung Chen, New Taipei (TW)

(73) Assignee: Apple Inc., Cupertino, CA (US)

( * ) Notice: Subject to any disclaimer, the term of this patent is extended or adjusted under 35 U.S.C. 154(b) by 73 days.

(21) Appl. No.: 16/929,021

(22) Filed: Jul. 14, 2020

(65) Prior Publication Data

US 2020/0337396 A1 Oct. 29, 2020

Related U.S. Application Data

(63) Continuation of application No. 15/802,280, filed on Nov. 2, 2017, now Pat. No. 10,716,344, which is a (Continued)

(51) Int. Cl.

| | |
|---|---|
| ***A44C 5/00*** | (2006.01) |
| ***A41D 20/00*** | (2006.01) |
| ***A44C 5/02*** | (2006.01) |
| ***A44C 5/20*** | (2006.01) |
| ***A44C 27/00*** | (2006.01) |

(52) U.S. Cl.

CPC ..... *A41D 20/00* (2013.01); *A44C 5/0061* (2013.01); *A44C 5/02* (2013.01); *A44C 5/20* (2013.01); *A44C 27/00* (2013.01); *A44C 27/001* (2013.01); *A44C 5/2071* (2013.01); *A44C 27/002* (2013.01); *A44D 2203/00* (2013.01); *Y10T 24/32* (2015.01); *Y10T 24/4782* (2015.01)

(58) Field of Classification Search

CPC ..... A41D 20/00; A44C 5/0061; A44C 5/02; A44C 5/20; A44C 27/00; A44C 27/001

See application file for complete search history.

(56) References Cited

U.S. PATENT DOCUMENTS

| | | | |
|---|---|---|---|
| 1,797,583 | A | 3/1931 | Miller |
| 2,388,554 | A | 11/1945 | Kreisler et al. |

(Continued)

FOREIGN PATENT DOCUMENTS

| | | |
|---|---|---|
| CN | 2219613 Y | 2/1996 |
| CN | 100584239 | 1/2010 |

(Continued)

OTHER PUBLICATIONS

Chinese Office Action from Chinese Application No. 201510479229, dated Jan. 11, 2017.

(Continued)

*Primary Examiner* — Richale L Quinn

(74) *Attorney, Agent, or Firm* — BakerHostetler

(57) ABSTRACT

A metallic mesh material used to form a portion of a band or securing strap for a wearable electronic device. The band may include a magnetic tab for securing a wearable device to the wrist of a user. The tab may include one or magnetic elements that are configured to engage a surface of the mesh to secure the wearable device to the wrist of a user.

20 Claims, 20 Drawing Sheets

Related U.S. Application Data continuation of application No. 14/641,227, filed on Mar. 6, 2015, now Pat. No. 9,826,789.

(60) Provisional application No. 62/035,425, filed on Aug. 9, 2014.

(56) References Cited

U.S. PATENT DOCUMENTS

| | | | | |
|---|---|---|---|---|
| 2,451,780 | A * | 10/1948 | Siska | A44C 5/0061 D11/12 |
| 2,564,652 | A | 8/1951 | Templeman | |
| 2,613,415 | A | 10/1952 | Ritter | |
| 2,648,884 | A * | 8/1953 | Loofboro | A44C 5/2071 24/303 |
| 2,696,689 | A | 12/1954 | Speck et al. | |
| 3,417,578 | A * | 12/1968 | Anderson | A44C 5/185 63/5.1 |
| 3,531,948 | A * | 10/1970 | Anderson | A44C 5/185 63/5.1 |
| 4,051,668 | A | 10/1977 | Learn | |
| 4,539,736 | A * | 9/1985 | Yokosuka | E05G 7/00 24/574.1 |
| 4,627,231 | A * | 12/1986 | Kiuchi | A44C 11/00 63/4 |
| 4,648,161 | A * | 3/1987 | Rosen | A44C 5/2085 24/644 |
| 4,941,236 | A | 7/1990 | Sherman | |
| 5,701,640 | A | 12/1997 | Locher | |
| 5,774,957 | A * | 7/1998 | Kohl | A44C 5/2057 24/616 |
| 6,058,576 | A * | 5/2000 | Harris | A44C 5/2057 24/616 |
| 6,237,319 | B1 | 5/2001 | Amundsen et al. | |
| 6,598,271 | B2 | 7/2003 | Nire | |
| 6,598,272 | B2 | 7/2003 | Nire | |
| 7,021,041 | B2 | 4/2006 | Verdon et al. | |
| 7,708,456 | B2 | 5/2010 | Kraus | |
| 7,827,622 | B2 * | 11/2010 | Claro | A42B 1/22 2/209.13 |
| 8,029,185 | B2 * | 10/2011 | Faucher | A44C 5/2076 368/282 |
| 8,191,209 | B2 | 6/2012 | Wolfgang | |
| 8,328,073 | B1 | 12/2012 | Smith | |
| 8,461,952 | B1 * | 6/2013 | Fullerton | H01F 1/01 335/285 |
| 8,567,172 | B2 * | 10/2013 | Asami | A44C 5/0053 63/7 |
| 8,576,036 | B2 | 11/2013 | Fullerton et al. | |
| 8,953,310 | B2 | 2/2015 | Smith | |
| 8,963,668 | B2 * | 2/2015 | Fullerton | H01F 7/0278 335/306 |
| 8,997,318 | B2 * | 4/2015 | Nicolas | A44C 5/14 24/303 |
| 9,055,791 | B2 * | 6/2015 | Proud | G16H 15/00 |
| 9,392,829 | B2 | 7/2016 | Manuello | |
| 9,420,856 | B2 * | 8/2016 | Proud | A44C 5/2071 |
| 9,826,789 | B2 * | 11/2017 | Dey | A44C 27/00 |
| 9,907,345 | B2 * | 3/2018 | O'Neill | A41F 1/002 |
| 10,123,608 | B2 * | 11/2018 | Kosoglow | A45F 5/00 |
| 10,219,591 | B2 * | 3/2019 | Hatanaka | G04B 37/1486 |
| 10,716,344 | B2 * | 7/2020 | Dey | A44C 27/00 |
| 10,716,369 | B2 * | 7/2020 | Tobiassen | A44C 5/2071 |
| 10,897,967 | B1 * | 1/2021 | Plotner | A44C 5/185 |
| 11,033,083 | B1 * | 6/2021 | Moustafa | H01F 7/0263 |
| D947,053 | S * | 3/2022 | Akana | D10/122 |
| 11,324,908 | B2 * | 5/2022 | Holyoake | A61M 16/0875 |
| 2004/0154143 | A1 * | 8/2004 | Harrell | A44C 5/2076 24/303 |
| 2005/0102802 | A1 | 5/2005 | Sitbon | |
| 2006/0196021 | A1 | 9/2006 | Touzov | |
| 2008/0184737 | A1 | 8/2008 | Wiseman | |
| 2008/0256979 | A1 | 10/2008 | Okamura | |
| 2009/0031757 | A1 | 2/2009 | Harding | |
| 2009/0083949 | A1 * | 4/2009 | Wolfgang | A44C 5/16 24/265 WS |
| 2014/0043741 | A1 | 2/2014 | Smith | |
| 2014/0101899 | A1 | 4/2014 | Moille | |
| 2014/0254083 | A1 * | 9/2014 | Wang | G06F 1/163 361/679.31 |
| 2015/0121668 | A1 | 5/2015 | Kaltenrieder | |
| 2015/0305462 | A1 * | 10/2015 | Rothbaum | B65D 63/10 224/575 |
| 2016/0003269 | A1 * | 1/2016 | Russell-Clarke | A43C 11/1493 24/303 |
| 2016/0007697 | A1 * | 1/2016 | de Jong | G06F 1/1662 63/3.1 |
| 2016/0025119 | A1 | 1/2016 | Russell-Clarke | |
| 2016/0037841 | A1 * | 2/2016 | Dey | A44C 27/001 2/170 |
| 2016/0037874 | A1 * | 2/2016 | Webb | A45F 5/00 224/267 |
| 2016/0037878 | A1 * | 2/2016 | Yabe | A44C 5/2071 24/627 |
| 2016/0037897 | A1 * | 2/2016 | Bataillou | A45F 5/00 224/267 |
| 2016/0198813 | A1 * | 7/2016 | Fiedler | H04B 1/385 224/183 |
| 2016/0236263 | A1 * | 8/2016 | Sawyer | B21F 15/04 |
| 2016/0270491 | A1 * | 9/2016 | Spencer | A44C 5/185 |
| 2016/0316839 | A1 | 11/2016 | King | |
| 2016/0358156 | A1 * | 12/2016 | Proud | A44C 5/0015 |
| 2017/0086536 | A1 * | 3/2017 | de Iuliis et al. | A44C 5/107 |
| 2017/0265607 | A1 * | 9/2017 | Hatanaka | G04B 37/1486 |
| 2018/0049492 | A1 * | 2/2018 | Dey | A44C 27/001 |
| 2018/0210400 | A1 * | 7/2018 | Kaneko | A44C 5/2071 |
| 2018/0213895 | A1 * | 8/2018 | Green | A44C 5/2071 |
| 2019/0365061 | A1 * | 12/2019 | Martin | A44C 5/0053 |
| 2020/0060392 | A1 * | 2/2020 | De Iuliis | A44C 5/2076 |
| 2020/0323316 | A1 * | 10/2020 | Lui | A44C 5/0053 |
| 2020/0337396 | A1 * | 10/2020 | Dey | A41D 20/00 |
| 2020/0367613 | A1 * | 11/2020 | Moustafa | A41D 20/00 |
| 2021/0267325 | A1 * | 9/2021 | Moustafa | A44C 5/16 |
| 2021/0274892 | A1 * | 9/2021 | Maynard | A44C 5/003 |
| 2021/0321729 | A1 * | 10/2021 | Schilling | A44C 5/2071 |

FOREIGN PATENT DOCUMENTS

| | | | |
|---|---|---|---|
| CN | 201393583 | | 2/2010 |
| CN | 102989159 | | 3/2013 |
| CN | 204861557 | | 12/2015 |
| DE | 202007018237 | U1 | 4/2008 |
| DE | 202012102780 | | 9/2012 |
| EP | 0040504 | | 11/1981 |
| EP | 0698355 | A1 | 2/1996 |
| EP | 1980170 | | 10/2008 |
| EP | 2260910 | | 12/2010 |
| EP | 2679113 | | 1/2014 |
| FR | 696020 | A | 12/1930 |
| WO | WO 01/32045 | | 5/2001 |
| WO | WO 03/056956 | | 7/2003 |
| WO | WO 2014/144127 | | 9/2014 |
| WO | WO-2015031501 | A1 * | 3/2015 ..... A44C 5/0053 |

OTHER PUBLICATIONS

Chinese Office Action from Chinese Application No. 201810356726.7, dated Jul. 11, 2019, 17 pages including English language translation.

Chinese Office Action from Chinese Application No. 201810356726.7, dated Mar. 2, 2020, 9 pages including English language translation.

Extended European Search Report, European Patent Application No. EP15180060, 8 pages, dated Sep. 10, 2015.

International Search Report and Written Opinion, PCT/US2015/043341, 17 pages, dated Jan. 14, 2016.

Invitation to Pay Additional Fees, PCT/US2015/043341, 5 pages, dated Oct. 9, 2015.

Partial European Search Report, European Patent Application No. EP15180060, 8 pages, dated Sep. 10, 2015.

(56) References Cited

OTHER PUBLICATIONS

Chinese Office Action dated Jul. 10, 2020 from Chinese Patent Application No. 201810356726.7, 11 pages.
European Office Action dated Jun. 3, 2020, from European Patent Application No. 15180060.4, 4 pages.
Chinese Office Action from Chinese Patent Application No. 202110005909.6, dated Dec. 15, 2022, 22 pages including English language summary.

* cited by examiner

SECTION A-A

SECTION A-A

SECTION A-A

SECTION A-A

*SECTION B-B*

*SECTION B-B*

*SECTION C-C*

*SECTION D-D*

*SECTION D-D*

*SECTION D-D*

*SECTION E-E*

MILANESE BAND

CROSS-REFERENCE TO RELATED APPLICATIONS

This application is a continuation of U.S. patent application Ser. No. 15/802,280, filed Nov. 2, 2017, which is a continuation of U.S. patent application Ser. No. 14/641,227, filed Mar. 6, 2015, which is a nonprovisional patent application of and claims the benefit under 35 U.S.C. § 119(e) of U.S. Provisional Patent Application No. 62/035,425, filed on Aug. 9, 2014, and titled "Milanese Band," the disclosure of each of which is hereby incorporated by reference herein in its entirety.

TECHNICAL FIELD

The disclosure relates generally to components made from a mesh material, and more specifically, to a band strap formed from a metallic mesh that is integrated with various other elements.

BACKGROUND

In general, mesh materials may be used in a plurality of applications and industries. Some mesh materials are configured to be flexible and may be used similar to other textile-based products. In some cases, a metallic mesh material can be used in applications similar to a traditional non-metallic textile. However, some traditional metal mesh materials have drawbacks that prevent them from being widely adopted. For example, some traditional metal mesh materials may lack the flexibility or surface finish for some applications. Additionally, it may be difficult to join a metallic mesh with other components or integrate the mesh with other components of a device or product.

SUMMARY

The following disclosure generally relates to components or devices made with a mesh material. In particularly a metallic mesh material may be used to form a portion of a band or securing strap for a wearable device. The band may include or be integrated with a magnetic tab for securing a wearable device to the wrist of a user. The tab may include one or magnetic elements that are configured to engage a surface of the mesh to secure the wearable device to the wrist of a user. A friction-enhancing member may also be disposed on a surface of the tab to improve the engagement of the tab. Techniques for manufacturing a mesh band are also described herein.

One example embodiment includes a consumer product, such as a wearable electronic device, having a body connected to a band strap. A magnetic tab may be attached to a free end of the band strap. The magnetic tab includes at least one magnetic element. A second tab element may include a loop having an aperture for receiving the free end of the first band strap. The magnetic tab may be configured to pass through the aperture and attach to a surface of the first band strap. The loop may be attached to the body of the device or, alternatively, to a second band strap that is attached to the body of the device. In some embodiments, the body includes an electronic device enclosure and the band strap is formed from a metallic mesh material. In some cases, the magnetic tab also includes an attachment face having a substantially flat surface that is configured to mate to the surface of the first band strap when the wearable electronic device is attached. In some cases, the magnetic tab includes an elastic member disposed on the attachment face. The elastic member may conform to and/or increase the friction between the surface of the first band strap and the tab. The magnetic tab may include one or more shunt elements on an opposite to the attachment face that are configured to shape the magnetic field of the magnetic tab.

In some embodiments, the magnetic tab includes multiple magnetic elements, including a center magnetic element having a magnetic pole orientation that is substantially perpendicular to the attachment face, and at least one side magnetic element having a magnetic pole orientation that is at a non-perpendicular angle with respect to the attachment face. In some cases, the angle is approximately 45 degrees.

In some embodiments, the magnetic tab includes a single magnetic element having a magnetic pole orientation that is substantially perpendicular to the attachment face.

In some embodiments, the magnetic tab includes multiple magnetic elements, including a first magnetic element having a magnetic pole orientation that is substantially perpendicular to the attachment face and oriented in a first direction, and a second magnetic element having a magnetic pole orientation oriented along a second direction that is opposite to the first direction.

In some embodiments, the magnetic tab includes multiple magnetic elements, including a first magnetic element having a magnetic pole that is substantially perpendicular to the attachment face and oriented in a first direction, a second magnetic element disposed between the first magnetic element and a second magnetic element, the second magnetic element having a magnetic pole that is oriented perpendicular to the first direction, and the third magnetic element having a magnetic pole that oriented in a third direction that is opposite to the first direction.

In some embodiments, the magnetic tab includes an attachment face that is configured to mate to or engage the surface of the first band strap when the wearable electronic device is attached. The magnetic claims may also include a friction-enhancing member disposed on the attachment face and configured to increase the resistance to shear when the magnetic tab is attached to the surface of the first band strap. The friction-enhancing member may include an elastic ring disposed in a groove on in the magnetic tab. In some cases, the friction-enhancing member may include a band formed around at least a portion of the perimeter of the magnetic tab.

In some embodiments, the magnetic tab may also include a groove feature and is joined to the free end of the first band strap, which includes a corresponding tongue feature. The tongue feature may be formed by compressing the metallic mesh material and then substantially filling any voids or gaps in the mesh with a braze or weld material to form a solid section.

In some embodiments, the magnetic tab is attached to the free end of the first band strap via a butt joint having at least one filet weld formed at the intersection between the magnetic tab and the free end of the first band strap. In some cases, the magnetic tab is attached to the free end of the first band strap via a slit joint having the free end of the band strap inserted into a slot in the magnetic tab, wherein at least filet weld is formed at the intersection between the magnetic tab and the free end of the first band strap.

One example embodiment includes a wearable electronic device having a body connected to a first and second band straps. A magnetic tab may be attached to a free end of the first band strap. The magnetic tab includes at least one magnetic element. A second band strap includes an aperture for receiving the free end of the first band strap. The magnetic tab may be configured to loop through the aperture and attach to a surface of the first band strap. In some embodiments, the body includes an electronic device enclosure and the first and second band straps are formed from a metallic mesh material.

One example embodiment includes a wearable electronic device having a body connected to a band strap. A tab element may be disposed at a free end of the band strap and a second tab element may be disposed at a free end of the second band strap or on the body of the device. The second tab element may have a aperture or loop for receiving the first tab element allowing the first tab element to mate with or engage a surface of the band strap. The band strap may be formed from a metallic mesh of interlocking links, and a portion of the edge of the first band strap may be removed to create a substantially flattened surface. In some cases, multiple pairs of crescent features are formed by a portion of the interlocking links that have been substantially flattened.

Some embodiments are directed to a method of forming an end of a mesh band. The method may include: forming a protrusion along the end of the mesh band; brazing the end of the mesh band to form a solid section that is substantially free of open space or internal cavities; and joining the mesh band to a mating part. An alternative method may comprise: placing a compression sleeve over an end of the mesh band; compressing the compression sleeve into the mesh band to form a protrusion; and laser-welding the compression sleeve and end of the mesh band to form a solid section that is substantially free of open space or internal cavities. The methods may further comprise: machining the protrusion to form a tongue feature inserting the tongue feature into a groove feature of a mating part; and attaching the mesh band to the mating part.

Another method of forming a mesh may comprise: thinning a mesh material using a roller to create a thinned mesh material, wherein the thinned mesh material has a thickness that is less than the mesh material; and disposing a compliant member between the roller and the mesh material during the thinning operation, wherein the compliant member distributes a force from the roller over the mesh material. In some cases, the compliant member is attached to an outer surface of the roller. In some cases, the compliant member is a sheet that is disposed adjacent an upper surface of the mesh material near the roller. In some cases, the method may further comprise disposing a lower compliant member adjacent to a lower surface of the mesh opposite to the roller.

DETAILED DESCRIPTION

Figure 1A:
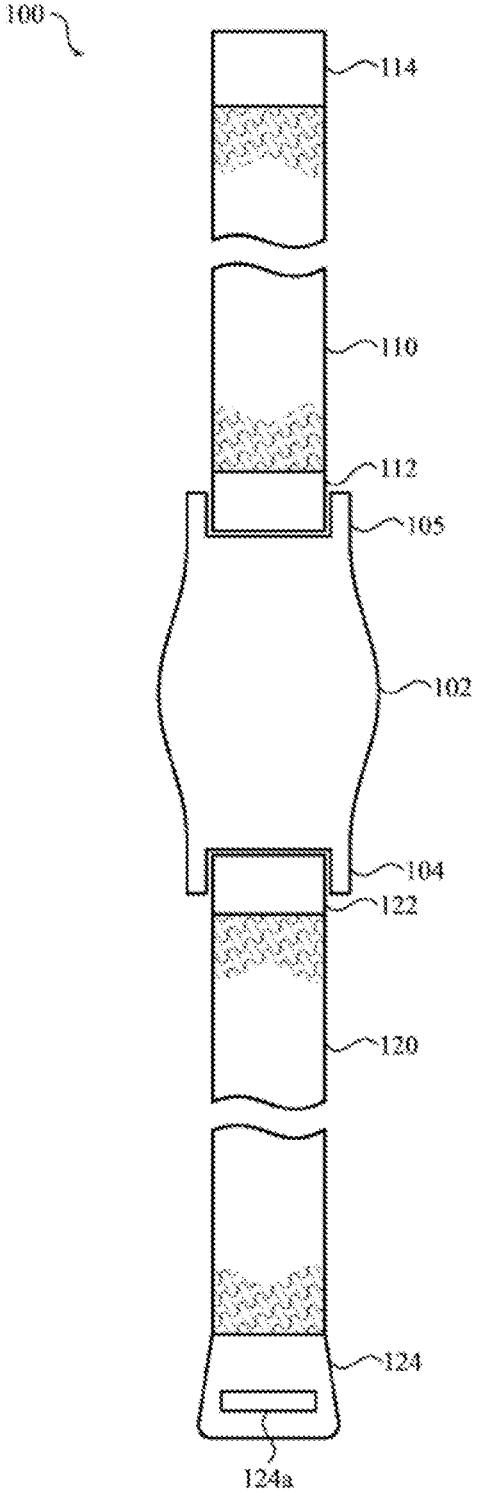
FIGS. 1A-B depict example devices having one or more components formed from a metallic mesh material.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to a consumer product having components or devices made with a mesh material, and more particularly, to a metallic mesh that has been adapted for use as a band or securing strap for a consumer product, such as a wearable electronic device. As discussed in more detail below, the band or band strap may include or be integrated with a magnetic tab for securing a consumer product to the wrist of a user. A metallic mesh may provide superior strength and durability, but, using some traditional techniques, may also be difficult to manufacture and/or integrate with other components. The techniques described herein may be used to make or form a band strap from a metallic mesh material, which may provide manufacturing advantages and/or improved functionality and features, as compared to some other traditional textile bands.

In some embodiments, the band strap includes a magnetic tab which is configured to attach the consumer product to the wrist of a user. The magnetic tab may be attached to one end of the band and may be configured to fold through a loop and magnetically couple to a surface of the band. In some embodiments, the loop may include a protective rail for reducing the risk of damage to the band in the case of a fall or impact. In some embodiments, the latch includes one or more magnets in a configuration that facilitate coupling to the band while, in some instances, also reducing the magnetic attraction to other objects or materials.

In some embodiments, the tab is attached to the metallic mesh using one of a variety of techniques. Some techniques described herein may be used to attach the tab to the band material to create a reliable and strong mechanical bond between the two components. In some instances, the band is attached to the tab using a brazing technique. In some instances, the a separate sleeve is placed on one end of the band and the end is formed into a substantially solid portion of material. The end may also be machined and bonded or otherwise mechanically attached to the tab or other component.

In some embodiments, the tab is attached to the metallic mesh using a combination of mechanical and adhesive techniques. In particular, in some cases, the tab includes a recess that is formed at an angle with respect to a corresponding mating feature on one end of the band. The end of the band may be inserted into the recess and then twisted slightly to provide a mechanical engagement between the two parts. In some embodiments, an adhesive, braising material, or other bonding agent is used to join the two pieces that are also mechanically interlocked.

In some embodiments, the metallic mesh material is compressed to obtain a desired thickness and also to compress individual links or loops in the mesh. In one example, a roller is used to flatten the metallic mesh material. In some cases, a compressible or compliant member is used to reduce faceting or flattening of the individual links during a flattening process. In some cases, the compressible or compliant member is located on the roller used to flatten the metallic mesh. In some cases, the compressible or compliant member is a sheet or strip of material that is placed on the surface of the metallic mesh during the rolling process. In some cases, a rolling process is alternated with a crushing process to maintain a consistent or even mesh pattern while thinning the mesh.

In some embodiments, the edges or sides of the metallic mesh are finished to provide a specific edge profile shape. In some cases, the edge of a metallic mesh band is ground to provide a substantially flat surface. Depending on the depth of the grind, different visual patterns in the edge of the mesh may be created. In one example, a double crescent or hurricane pattern is formed at the edge of the band. In some cases, a saw tooth or rampart pattern is formed at the edge of the band.

These and other embodiments are discussed below with reference to FIGS. 1-15. However, those skilled in the art will readily appreciate that the detailed description given herein with respect to these Figures is for explanatory purposes only and should not be construed as limiting.

Figure 1B:
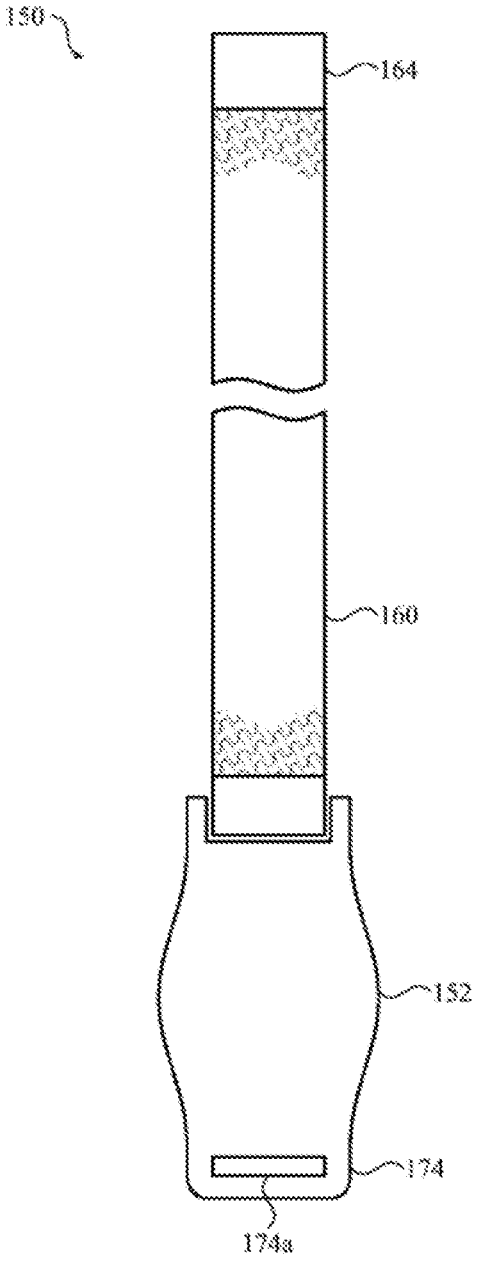

FIGS. 1A-B depict a top view of an example consumer product having one or more components formed from a mesh material. More specifically, FIG. 1A depicts an example wearable device 100 having band straps 110, 120 that are formed from a metallic mesh material. FIG. 1B depicts another example wearable device 150 having a single band strap 160 formed from a metallic mesh material. The wearable devices 100, 150 may be one of a variety of different types of devices including mechanical devices, electromechanical devices, electronic devices, and so on. In some embodiments, the wearable devices 100, 150 may include a mechanical watch. In some embodiments, the wearable devices 100, 150 may include an electronic device having one or more components configured to function as, for example, a watch device, a health monitoring device, a messaging device, a media player device, a gaming device, computing device, or other portable electronic device.

As shown in FIG. 1A, the wearable device 100 includes a first band strap 110 attached to a body 102 via a coupling joint 105. Similarly, a second band strap 120 is attached to the body 102 via another, second coupling joint 104. In this example, band strap 110 includes a coupling component 112 disposed at one end of the strap. Similarly, band strap 120 includes a coupling component 122 disposed at one end of the strap. The coupling components 112, 122 may be configured to mechanically engage the coupling joints 105, 104 to attach the band straps 110, 120 to the body 102. For example, the coupling joints 105, 104 may engage the coupling components 112, 122 via a pivoting hinge or pin engagement. In some cases, the coupling joints 105, 104 are configured to releasably engage the coupling components 112, 122 and allow the band straps 110, 120 to detach from the body 102. In some cases, the band straps 110, 120 may be detached manually using a tool or fixture. In some cases, the configuration of the coupling joints 105, 104 may themselves be removable to facilitate attachment or detachment of the band straps 110, 120 from the body 102.

In some embodiments, the coupling components 112, 122 may include one or more separate pieces that form an end of the respective band straps 110, 120. In some embodiments, the coupling components 112, 122 are formed into or integrated with the steel mesh material of the respective band straps 110, 120. Example forming and attachment techniques are described in more detail below with respect to FIGS. 9A-F, 10A-C, 11, and 12A-C.

As shown in FIG. 1A, the wearable device 100 also includes a mechanism that is configured to releasably engage respective ends of the band straps 110, 120 to attach the device 100 to a body part (e.g., the wrist) of the user. In the present example, the first band strap 110 includes a magnetic tab 114 disposed at one end of the band strap 110. The second band strap 120 includes a loop 124 that is configured to receive the magnetic tab 114 and at least a portion of the first band strap 110. In the present example, the loop 124 includes an aperture 124*a* having a height and width that is configured to receive the magnetic tab 114. In other embodiments, the loop 124 may be formed from a partially enclosed shape, including, for example, a C-shaped or U-shaped feature. Additional loop embodiments are described in more detail below with respect to FIGS. 4A-D.

In general, to attach the wearable device 100 to a user, the body 102 may be placed against the user's wrist and the first and second band straps 110, 120 may be wrapped around the wrist. The magnetic tab 114 and a portion of the first band strap 110 may be inserted into the loop 124 allowing the bands to be tightened around the user's wrist. In some cases, the magnetic tab 114 includes at least one magnetic element and a face configured to attach to a portion of the first band strap 110 located between a first and second end. In some embodiments, because the magnetic tab 114 can attach along virtually any position along the first band strap 110, the magnetic tab 114 provides for an infinitely adjustable band.

FIG. 1B depicts an example of a wearable electronic device 150 having a single band strap 160. Similar to the previous example, the band strap 160 of the device 150 includes a magnetic tab 164. As shown in FIG. 1B, the device 150 includes a body 152 that is attached to or integrally formed with a loop 174 having an aperture 174*a*. In the present embodiment, the loop 174 includes an aperture 174*a* having a height and width that is configured to receive the magnetic tab 164. In other embodiments, the loop 174 may be formed from a partially enclosed shape, including, for example, a C-shaped or U-shaped feature. In some embodiments, the loop 174 may be formed as a unitary structure with the body 152. In some embodiments, the loop 174 may be formed as a separate piece that is attached to the body 152.

Similar to the previous example, the band strap 160 of FIG. 1A may be configured to pass through the loop 174 and fold back on itself to secure the device 150 to the wrist of the user. In particular, the magnetic tab 164 may be fed through the aperture 174*a* of the loop 174 and folded back to attach the magnetic tab 164 to a face of the band strap 160. The band strap 160 may be tightened around the user's wrist by pulling the band strap 160 through the aperture 174*a* and attaching the magnetic tab 164 onto the band strap 160 at the desired location. In this way, the magnetic tab 164 provides for an infinitely adjustable band strap 160.

Figure 2A:
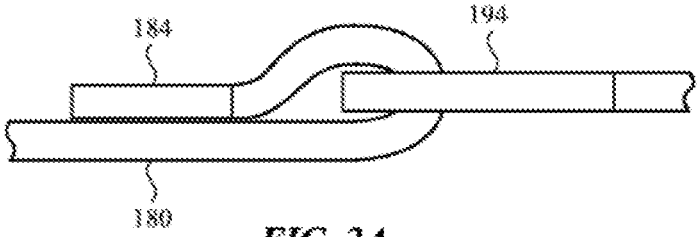
FIGS. 2A-B depicts a detail view of an end of a band formed from a metallic mesh material and an example tab.
Figure 2B:
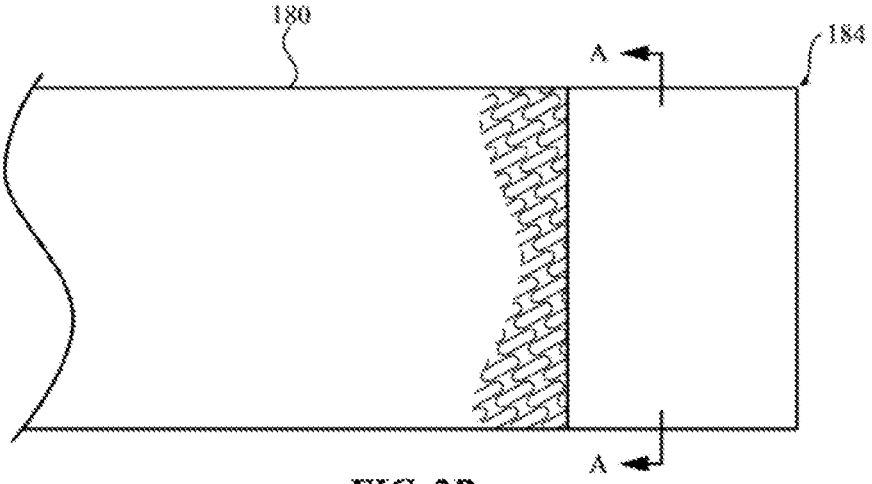

FIG. 2A depicts a side view of an example attachment scheme that is applicable to both devices depicted in FIGS. 1A-B. As shown in FIG. 2A, a band strap 180 having a magnetic tab 184 may be configured to be inserted through a loop 194 having an aperture or opening. As previously described, the loop 194 may be formed into the end of a mating strap or, alternatively, may be formed into or attached to the body of the device. As shown in FIG. 1B, the band strap 180 is sufficiently flexible to wrap around the loop 194 and fold onto itself to secure the band strap 180 around the user. In the example depicted in FIG. 2A, the band strap 180 is configured to form an approximately 180 degree bend through the loop 194 allowing the magnetic tab 184 to come into contact with or mate to a surface of the band strap 180. In the present embodiment, the magnetic tab 184 is configured to be magnetically attracted to the surface of the band strap 180, which may be formed, in part, from a ferromagnetic material of the mesh. The magnetic attraction between the mesh of the band strap 180 and the magnetic tab 184 may prevent slip or shear between the two elements, and thereby secure the wearable device to the user's wrist. FIG. 2B depicts a top view of the band strap 180 and the attachment face of the magnetic tab 184.

Figure 3:
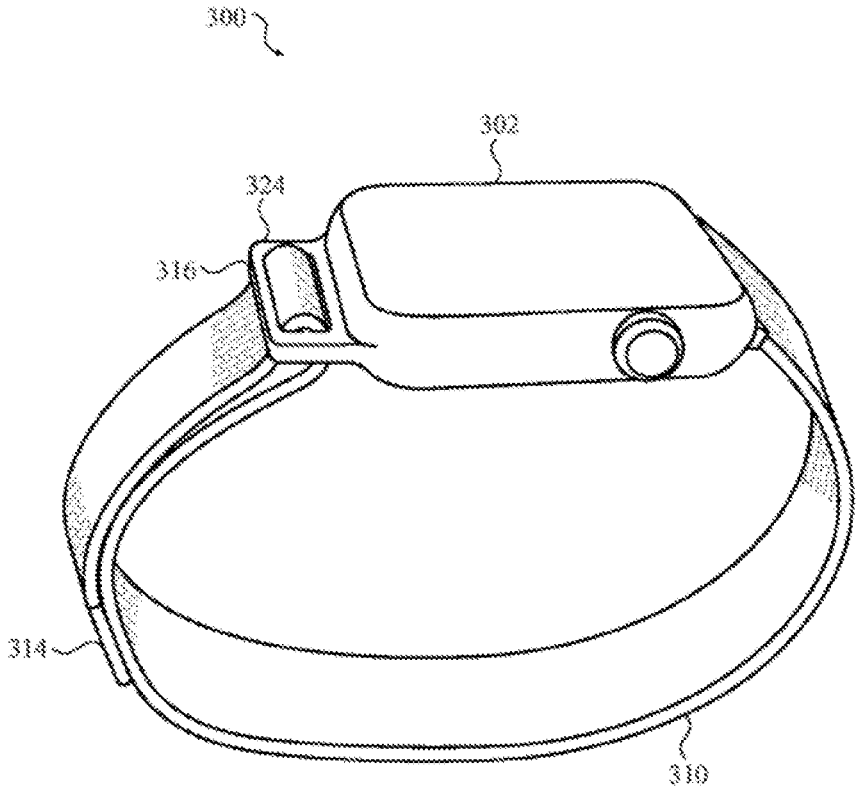
FIG. 3 depicts an example device having a loop embodiment with a protective rail.

FIG. 3 depicts an example device having a loop embodiment with a protective rail. As shown in FIG. 3, the device 300 includes a body 302 and a band 310 that is configured to be attached to a body part (e.g., the wrist) of a user. In the present embodiment, the band 310 has a first end that is attached to the body 302 and a second end having a tab 314 that is configured to feed through an aperture of a loop 324 and attach to a surface of the band 310. Similar to the previous examples, the band 310 may be pulled through the aperture of the loop 324 to tighten the band 310 around the user's wrist.

In the example depicted in FIG. 3, the loop 324 includes a protective rail 316 that extends around or is disposed about an outer surface of the band 310 when the band 310 is woven through the loop 324. The protective rail 316 may be configured to prevent or reduce the risk of damage to the band 310 that could be caused by a fall or impact. In particular, the protective rail 316 is configured to prevent the mesh of the band 310 from becoming bent or kinked by the loop 324 if the device 300 is dropped or receives an impact near the loop 324. As shown in FIG. 3, the protective rail 316 is integrally formed as a unitary structure with the loop 324 and the body 302. In other examples, the protective rail 316 may be formed from a separate piece. In the present embodiment, the protective rail 316 extends along both edges and the outer surface of the band 310 to form a fully closed shape around or about the surface of the band 310. However, in other embodiments, the protective rail may be formed as a partially open shape, such as a bar or post.

Figure 4A:
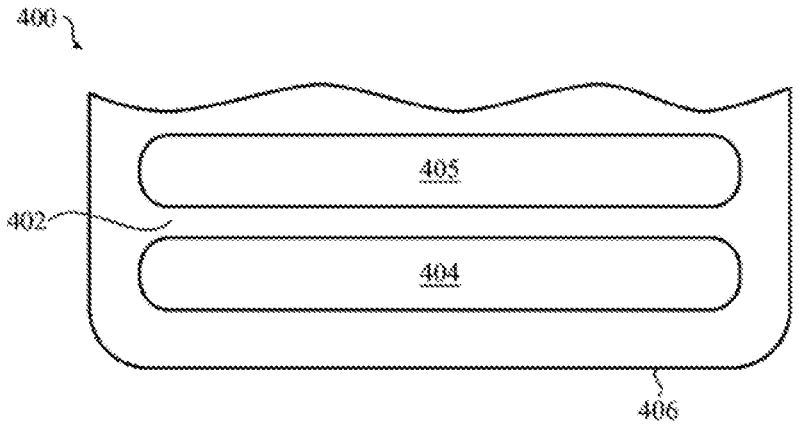
FIGS. 4A-D depict example loops having protective rails.
Figure 4B:
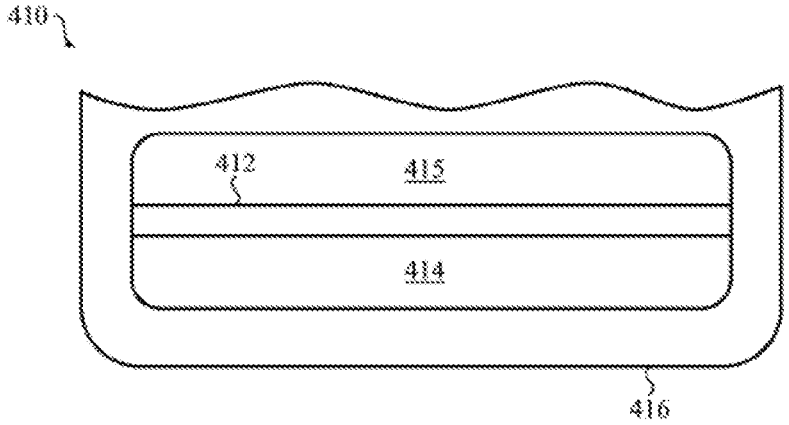
Figure 4C:
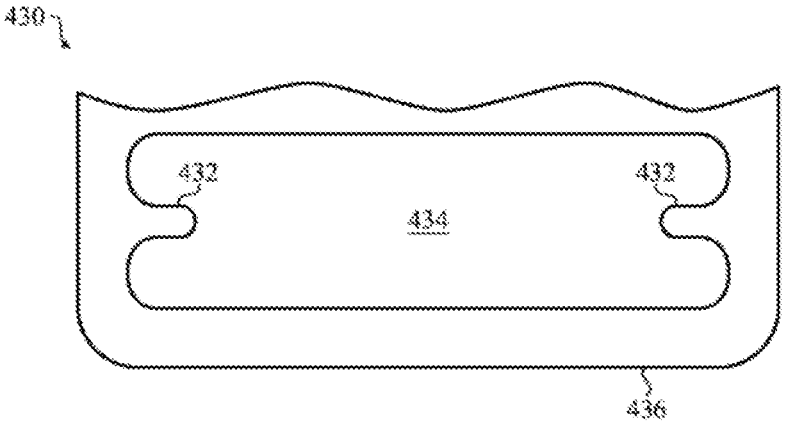

Example alternative embodiments of a protective rail and loop are depicted in FIGS. 4A-C. FIG. 4A depicts a partial view of an example loop 400 that may be formed into or attached to a device body, as described above with respect to FIG. 3. As shown in FIG. 4A, the example loop 400 includes apertures 405 and 404 that are formed within the body of the loop 400. The two apertures 405 and 404 are separated by a web 402, which is integrally formed into the unitary body of the loop 400. Similar to the example described above with respect to FIG. 3, a band having a tab may be inserted or fed through the first aperture 405, folded around the web 420 and inserted or fed back through the second aperture 404. The loop 400 also includes a protective rail 406 that is integrally formed within the unitary body of the loop 400.

FIG. 4B depicts another example embodiment of a loop 410 having a protective rail 416. In the example depicted in FIG. 4B, two apertures 415, 414 are formed within the loop 410 and are separated by a web 412. In this example, the web 412 is formed from a rod or cylindrical bar that is attached to a separate perimeter portion of the loop 410. Because the web 412 is rounded, the band may more easily fold over the web 412 when it is fed through the two apertures 415, 414 to attach a device to the body of a user. In some embodiments, the web 412 is able to rotate or spin to facilitate insertion and sliding of the mesh within the loop 410. For example, the web 412 may be formed from a rod that extends across the opening in the loop 410. In some cases, a hollow tubular sleeve may be placed over the rod and be seized to allow for the sleeve to spin with respect to the rod. The web 412 may be attached using a threaded fastener, weld, or other suitable attachment technique.

FIG. 4C depicts another example embodiment of a loop 430 having a protective rail 436. In the example depicted in FIG. 4C, a single aperture 434 is formed within the loop 430. In the present embodiment, the band may be folded over tangs 432 when attaching the band to the body of a user. In particular, the band may be fed through a portion of the aperture 434
that is located between the tangs 432 and the body of the device. The band may then fold over the tangs 432 and back through another portion of the aperture 434 that is located between the tangs 432 and the protective rail 436. In some embodiments, the tangs 432 include a radius or rounded edge to facilitate the insertion and/or sliding of the mesh within the loop 430. In the embodiment of FIG. 4C, the protective rail 436 is integrally formed into the unitary body of the loop 430. However, in alternative embodiments, the protective rail 436 may be formed from a separate piece.

In some embodiments, the width of the aperture 434 is reduced as compared to a loop not having a protective rail. For example, a loop not having a protective rail (e.g., 174 of FIG. 1B) may have a width that is approximately 3 mm wider than the width of the mesh band (e.g., 150 of FIG. 1B). In some cases, the width of the aperture 434 is reduced by approximately
1 mm as compared to a loop aperture not having a protective rail. In some cases, the width of the aperture 434 is reduced by approximately 1.5 mm as compared to a loop not having a protective rail. In some cases, the width of the aperture 434 is reduced by approximately 2 mm as compared to a loop not having a protective rail. Other embodiments having a protective rail may be similarly reduced in size along the width of the aperture(s).

Figure 4D:
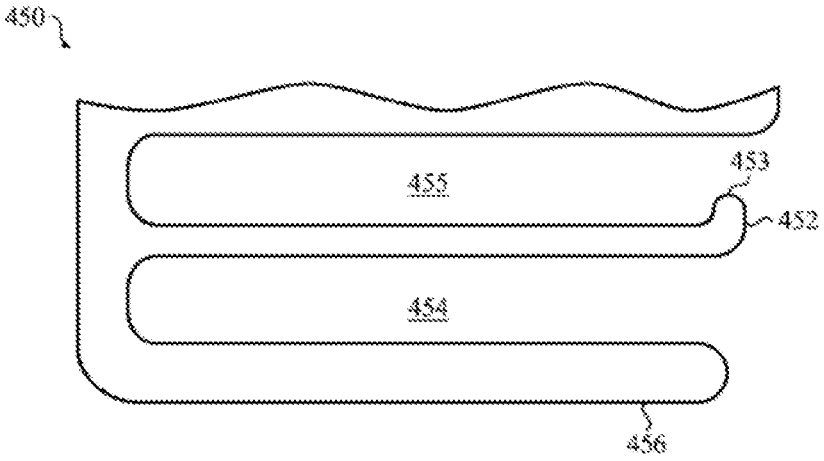

FIG. 4D depicts another example embodiment of a loop 450 having a protective rail 456. In the example depicted in FIG. 4D, an aperture 455 is formed between the web 452 and the body of the device. In this example, the aperture 455 is an open C-shaped section formed into the loop 450. As shown in FIG. 4D, the C-shaped section also includes a tang 453, which prevents a strap from sliding out of the aperture 455 when fed through the loop 450. The loop 450 also includes a protective rail 456 that also forms an open C-shaped aperture 454. In the present embodiment, the web 452 and the protective rail 456 are integrally formed into the unitary body of the loop 450. However, in other embodiments, the protective rail 456, the web 452, or both may be formed from separate pieces and attached to the loop 450.

In some embodiments, the band straps of any of the previous examples (110, 120, 160, 180, 310) may be formed from a metallic mesh material. In some cases, the metallic mesh is formed from an array of links that are interlocked to form a sheet of fabric. Some or all of the links in the mesh may be formed from a ferromagnetic material, which may facilitate magnetic engagement with the magnetic tab, as described above. In some cases, each link of the mesh is formed from a section of metallic filament that is bent or formed into a closed shape. In some cases, the links of the mesh are formed from a metallic filament that is bent or formed into a spiral or coil shape. Each link may be interlocked with one or more adjacent links to form a portion of the sheet or fabric. In some cases, a metallic filament is formed around a series of rods or pins that are disposed at a regular spacing within the mesh. In some cases, one or more strands or filaments that may be formed from a ferromagnetic material are woven or integrated with the links of the mesh. A variety of link-based mesh configurations may be suitable for use in the band straps described in the present disclosure.

The metallic mesh may not necessarily be formed entirely of metallic materials and, more specifically, ferromagnetic materials. For example, in some embodiments, some of the links are formed from a ferromagnetic material and some of the links may be formed from a material that is not ferromagnetic. In some cases, some or all of the non-ferromagnetic links may be formed from a non-metallic material, including, without limitation, ceramics, polymers, plastics, and natural or synthetic fibers. In some cases, some or all of the non-ferromagnetic
links may be formed from a metallic material that is not ferromagnetic. For example, the non-ferromagnetic links may be formed from a copper, silver, gold, aluminum, magnesium, platinum, or other non-magnetic metal material. In some cases, the mesh includes one or more strands or filaments that are woven or integrated with the links. The one or more strands or filaments may also be either a ferromagnetic or non-ferromagnetic material. A combination of materials may be selected based on density of the ferromagnetic materials suitable for engaging the magnetic tab and other factors, such as mesh finish, mesh appearance, and/or mechanical properties of the mesh material.

Additionally, the band straps (110, 120, 160, 180, 310) may be formed from a metallic mesh material that comprises a woven material that includes one or more strands or threads formed from a ferromagnetic material. In one example, the mesh is formed from a plurality of warp threads that are woven around one or more weft threads. More specifically, the mesh may include a plurality of warp threads disposed along the length of the band strap and at least one weft thread positioned perpendicular to, and coupled to, woven or interlaced between the plurality of warp threads. In some cases, the plurality of warp threads may run the entire length of the mesh portion of the band strap. Additionally, in some cases, the at least one weft thread may include a single thread that may be continuously woven between the plurality of warp threads or, alternatively, may include a plurality of threads that may be woven between the plurality of warp threads. A weft thread that is woven between a plurality of warp threads may form consecutive cross-layers with respect to the plurality warp threads in order to form the mesh.

Similar to as described above, a metallic (woven) mesh may not necessarily be formed entirely of metallic materials and, more specifically, ferromagnetic materials. For example, in some embodiments, some of the threads may be formed from a ferromagnetic materials and some of the threads may be formed from a material that is not ferromagnetic. In some cases, some or all of the non-ferromagnetic threads may be formed from a non-metallic material, including, without limitation, polymers, plastics, and natural or synthetic fibers. In some cases, some or all of the non-ferromagnetic threads may be formed from a metallic material that is not ferromagnetic. For example, the non-ferromagnetic links may be formed from a copper, silver, gold, aluminum, magnesium, platinum, or other non-magnetic metal material. As in the previous example, the combination of materials may be selected based on density of the ferromagnetic materials required for engaging the magnetic tab and other factors, such as mesh finish, mesh appearance, and/or mechanical properties of the mesh material. Additionally, while it may be advantageous for multiple band straps (e.g., first and second band straps 110, 120) to be formed from the same type of material to provide a uniform appearance, it may not be necessary that the multiple band straps be the same for the functional performance of the magnetic tab.

In some cases, the metallic mesh material includes a lubricant material that facilitates the relative movement of the individual links (or threads) with respect to each other. For example, a lubricant material may reduce rubbing friction when the mesh is bent and/or flattened. The lubricant material may also allow the mesh to return a natural shape that is free from kinks after being bent. In some cases, the lubricant material includes a dry powdered lubricant material. For example a polytetrafluoroethylene (PTFE) or PTFE-composite particle powder may be applied to the mesh material using a dip or immersion process. In some cases, the lubricant, as applied, includes a solvent material that evaporates leaving the lubricant material in the mesh. In some cases, a light oil or wet lubricant may be applied to the mesh material using a spray or other liquid application process.

FIG. 2B depicts a detail view of an end of a band formed from a mesh material and an example tab. In the present example, the tab 184 is attached to an end of the band strap 180, which is formed from a mesh material. As described above, the mesh material may be formed from one or more ferromagnetic materials to facilitate magnetic engagement with the tab 184. As also described above, the mesh material may also be formed from other non-ferromagnetic or even non-metallic materials. The tab 184 may be mechanically joined to the end of the band strap 180 using a variety of joining techniques. Some example joining techniques are described below with respect to FIGS. 9A-F, 10A-C, 11, and 12A-C.

In the present embodiment, the tab 184 includes at least one magnetic element and an attachment face configured to attach to or otherwise engage a portion of the first band strap 180 located between the ends the band strap 180. FIGS. 5A-D depict cross sectional views of different example tabs taken along section A-A. In each of the examples provided below, one or more magnetic elements are used to generate a magnetic field over an attachment face of the tab. The magnetic elements may be formed from a variety of magnetic materials, including, for example, rare-earth magnetic materials, iron, cobalt, nickel, alloy or composite magnetic materials, and the like.

Figure 5A:
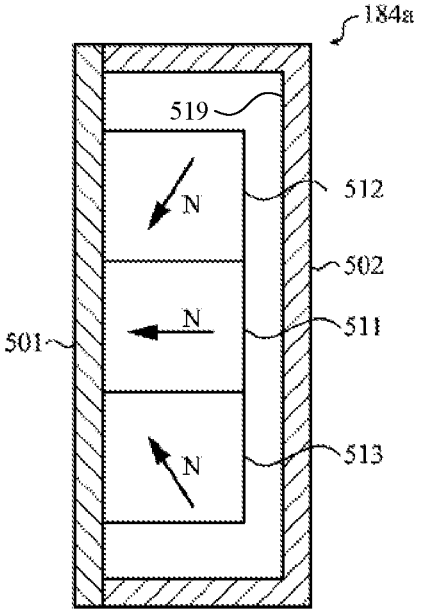
FIGS. 5A-D depict cross sectional views of different example tabs taken along section A-A.

FIG. 5A depicts a cross sectional view taken along section A-A of a first example configuration of a tab. As shown in FIG. 5A, the magnetic tab 184*a* is formed as a two-piece enclosure including shell 502 and cap 501. In some embodiments, the shell 502 and cap 501 are formed from a metal or ferromagnetic material and fastened or otherwise bonded together to form the enclosure. The shell 502 and cap 501 may be formed from a variety of other materials, including, for example, non-metallic or non-ferromagnetic materials. FIGS. 5A-D depict one example configuration of an enclosure formed from two pieces. However, in other embodiments, the enclosure may be formed as a single piece or may be formed from more than two pieces. In some embodiments, the shell 502 may be formed from a ferromagnetic material that is configured to shape the magnetic fields of the magnetic elements positioned within the tab 184*a*.

As shown in FIG. 5A, the shell 502 and cap 501 form an internal cavity. In this example, three magnetic elements 511, 512, 513 are disposed in the internal cavity of the tab 184*a*. The magnetic elements 511, 512, 513 may be arranged to focus or concentrate the magnetic field over a region, as depicted in FIG. 5A. In particular, the magnetic elements 511,
512, 513 may be configured to concentrate the magnetic field over a region of an attachment surface on the end cap 501. In the present example, a center magnetic element 511 is located between two side magnetic elements 512, 513. The center magnet 511 has a magnetic pole orientation that is substantially perpendicular to the attachment surface of the end cap 501. The center magnet 511 is disposed between the two side magnets 512, 513, which each have a magnetic pole orientation that is at an angle with respect to the attachment surface of the end cap 501. In the present example, the orientation of the poles of the side magnets 512, 513 is approximately 45 degrees with respect to the attachment surface. In other embodiments, the angle between the poles of the side magnets 512, 513 vary over a range between 10 degrees and 80 degrees. In some embodiments, the angle may vary over a range between 30 and 60 degrees.

FIG. 5A depicts one example embodiment of a magnetic tab having multiple magnets arranged to concentrate or focus the magnetic field using three magnetic elements. In other embodiments, more or fewer than three magnetic elements may be used. For example, in other embodiments more than one side magnetic element is arranged on either side of a center magnetic element. In another example, multiple magnetic elements having angled magnetic poles are arranged adjacent to each other and there is no center magnet having a pole that is perpendicular to the attachment face.

Figure 5B:
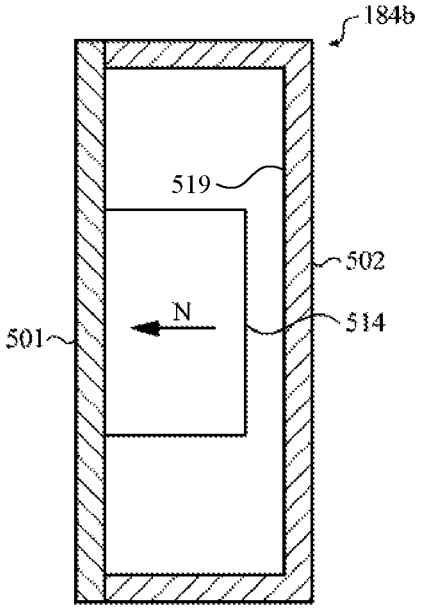

FIG. 5B depicts a cross sectional view taken along section A-A of a second example configuration of a tab. Similar to the example described above with respect to FIG. 5A, the tab 184*b* of FIG. 5B is formed as a two-piece enclosure including shell 502 and cap 501 that together form an internal cavity. The outer surface of the cap 501 may form the attachment surface of the tab 184*b*. In the example depicted in FIG. 5B, the magnet is formed from a single magnetic element 514. As shown in FIG. 5B, the magnetic element 514 has a magnetic pole orientation that is substantially perpendicular to the attachment face of the tab 184*b*.

Figure 5C:
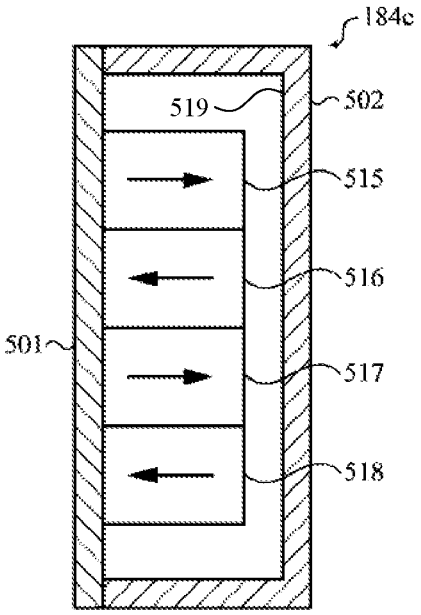

FIG. 5C depicts a cross sectional view taken along section A-A of a third example configuration of a tab. Similar to the examples described above, the tab 184*c* of FIG. 5C is formed as a two-piece enclosure including shell 502 and cap 501 that together form an internal cavity. The outer surface of the cap 501 may form the attachment surface of the tab 184*c*. In the present example, multiple magnetic elements 515-518 are disposed within the internal cavity of the tab 184*c*. The magnetic elements 515-518 are arranged adjacent to each other and each magnetic element has a magnetic pole orientation that is opposite to the orientation of an adjacent magnetic element. In some cases, the alternating arrangement of poles and the magnetic elements may result in a magnetic field that extends further away from the attachment face of the tab 184*c*, as compared to some non-alternating configurations.

In particular, in the example depicted in FIG. 5C, a first magnetic element 515 has a magnetic pole orientation along a first direction that is substantially perpendicular to the attachment face of the tab 184*c*. As shown in FIG. 5C, a second magnetic element 516 has a magnetic pole orientation that is oriented along a second direction that is opposite to the first direction. Similarly, a third magnetic element 517 has a magnetic pole orientation that is oriented along a direction that is opposite to the second direction of the second magnetic element 516. The magnetic pole orientation of the fourth magnetic element 518 is opposite to the pole orientation of the adjacent, third magnetic element 517.

Figure 5D:
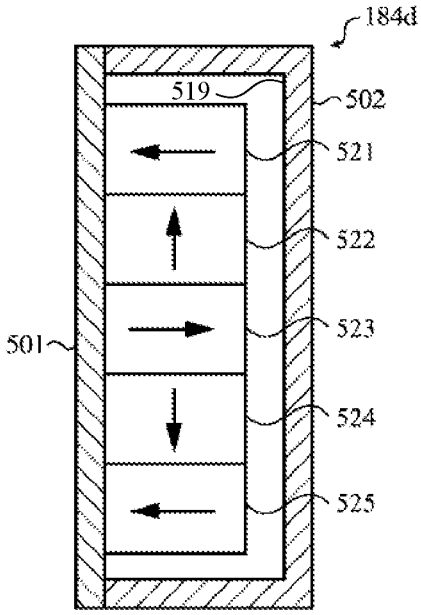

FIG. 5D depicts a cross sectional view taken along section A-A of a fourth example configuration of a tab. Similar to the examples described above, the tab 184*d* of FIG. 5D is formed as a two-piece enclosure including shell 502 and cap 501 that together form an internal cavity and where the outer surface of the cap 501 may form the attachment surface of the tab 184*d*. In the present example, multiple magnetic elements 521-525 are disposed within the internal cavity of the tab 184*d*. The magnetic elements 521-25 are arranged so that the orientation of adjacent magnetic poles are approximately orthogonal to each other. In some cases, such an arrangement of poles may help to direct the magnetic flux through the attachment face while also minimizing magnetic flux in other directions.

In the example depicted in FIG. 5D, a first magnetic element 521 has a magnetic pole that is oriented along a first direction that is substantially perpendicular to the attachment face. A second, adjacent magnetic element 522 has a magnetic pole that is oriented in a second direction that is perpendicular to the first direction of the first magnetic element 521. As shown in FIG. 5D, the second magnetic element 522 is disposed between the first magnetic element 521 and the third magnetic element 523. The third magnetic element 523 has a magnetic pole that is oriented in a third direction that is opposite to the first direction. The fourth magnetic element 524 and fifth magnetic element 525 are similarly arranged in a configuration that mirrors the first 521 and second 522 magnetic elements.

In each of the examples described above with respect to FIGS. 5A-D, the magnetic tab may also include one or more shunt elements 519 that are configured to redirect the magnetic flux produced by the one or more magnetic elements. For example, one or more of the side walls of the tab (e.g., the shell) may be formed from a material that is capable of shunting a portion of the magnetic field produced by the magnetic elements. In some cases, a shunting element is formed from one or more separate components that are disposed within the internal cavity of the tab. In one example, a shunt element is formed or inserted into the tab on a surface that is opposite to the attachment face. In some cases, the shunt plate may improve the strength and size of the magnetic field that is projected from the attachment face of the tab, thereby improving the attachment of the tab to the surface of the band.

A variety of configurations of the magnetic elements depicted in FIG. 5D may be implemented that are consistent with the principle of the embodiment. For example, the configuration depicted in FIG. 5D shows the first magnetic element 521 as having a pole orientation with the north end of the magnet oriented toward the attachment surface of the tab 184*d*. However, in other embodiments, the orientation of the first magnetic element 521 may be different, which would also result in different orientations for the other magnetic elements 522-525. Additionally, while five magnetic elements are used in the present configuration, more magnetic elements or fewer magnetic elements could also be used and arranged in a fashion consistent with the configuration depicted in FIG. 5D.

In some implementations the attachment face of the tab may include additional features or elements that improve the friction or grip properties of the tab. For example, one or more elastic members may be disposed on the attachment face of the tab. This may be advantageous for improving the strength and reliability of the tab when the wearable device is being worn. FIGS. 6A-B, 7A-B, and 8A-C depict example configurations of a tab having one or more elements for improving the surface properties of the tab.

Figure 6A:
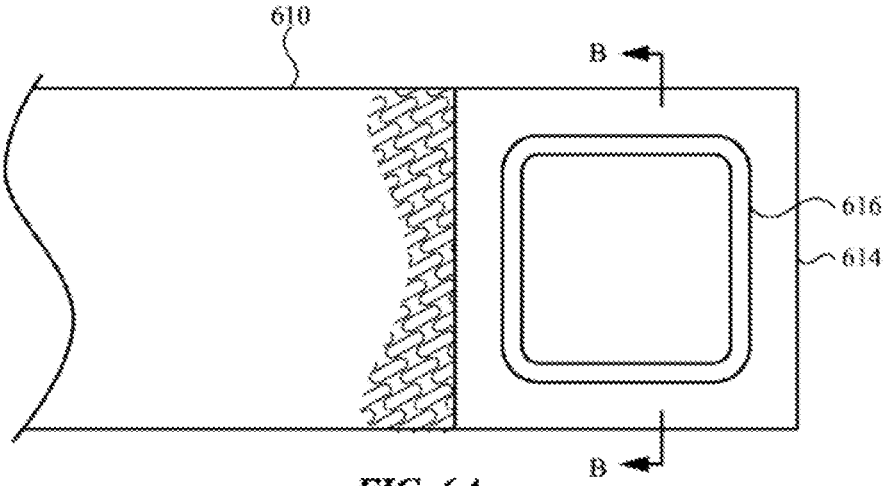
FIGS. 6A-B depict a detail view of an end of a band strap and an example tab having a friction-enhancing member.
Figure 6B:
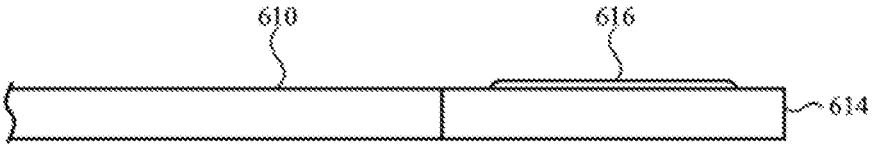

FIGS. 6A-B depict a top and side view of the end of a band strap having an elastic member integrated into the tab. In particular, an elastic or friction-enhancing member 616 is disposed on the attachment face of the tab 614. The tab 614 is attached to the free end of a band strap 610. As shown in FIG. 6A, the member 616 is offset from the perimeter of the tab 614 forming a rectilinear bounded area. As shown in FIG. 6B, the member 616 protrudes slightly from the attachment face of the tab 614.

In some cases, the friction-enhancing member 616 is formed from an elastic elastomer material. For example, the member 616 may be formed from a rubber, silicone, butyl, Viton, or similar material. In general, the member 616 has frictional properties that are greater than the material used to form the surface of the tab. In some cases, the member 616 may deflect slightly when the tab 614 is engaged with a mating mesh surface, which may further improve the frictional properties of the tab 614. As also shown in FIG. 6A, the area that is formed by the member 616 is substantially smaller than the total surface area of the tab 614. This may further improve the resistance to shear or grip the tab 614 by concentrating the engagement force over a relatively small amount of material.

In some cases, the size and shape of the member 616 are configured to correspond to the size and shape of elements that form the mesh. This may further improve the grip of the tab 614 by forming a mechanical interface between the member 616 and the mesh. For example, the member 616 may have a cross section that is approximately the same size as the pitch between elements in the mesh. In some cases, the member 616 may be configured to mechanically engage one or more of the elements (e.g., links) that form the mesh material, improving the shear grip between the two surfaces.

Figure 7A:
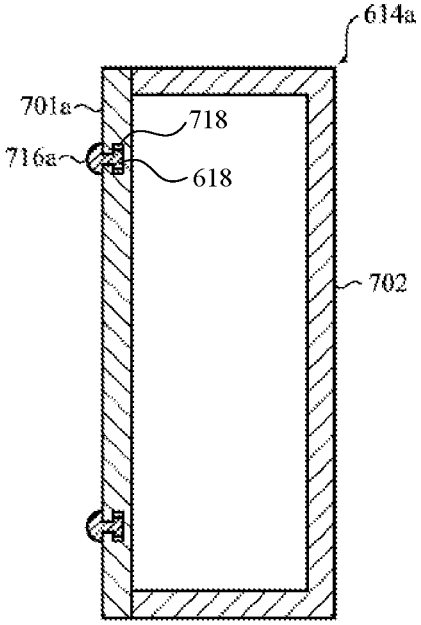
FIGS. 7A-B depict cross sectional views of different example tabs having a friction-enhancing member taken along section B-B.
Figure 7B:
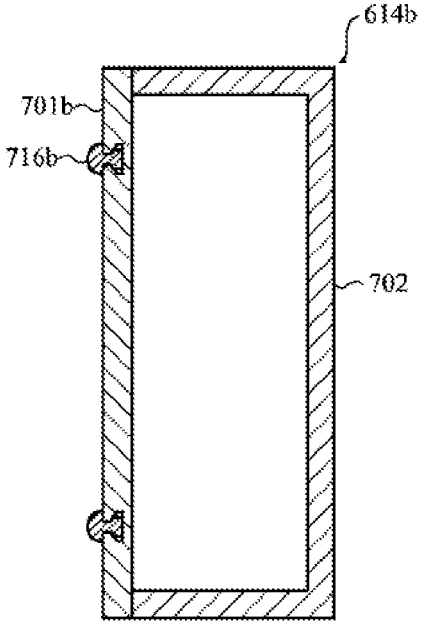

FIGS. 7A-B depict cross sectional views of different example tabs having a friction-enhancing member taken along section B-B. In the example depicted in FIG. 7A, the tab 614*a* includes a member 716*a* that is formed from an elastic ring of material having a profiled shape. The profile shape is specially configured for installation into a corresponding groove formed into the end cap 701*a*. In this example, the end cap 701*a* is attached to shell 702 to form an internal cavity. The tab 614*a* depicted in FIG. 7A may be used in combination with any of the magnetic element configurations described above.

As shown in FIG. 7A, the member 716 a includes a tongue feature 718 that is configured to engage a corresponding groove 618 feature formed into a surface of the tab 614 *a*. In this example, the tongue feature 718 includes a widened portion that is configured to fit into the groove 618 and expand into a corresponding widened portion of the groove 618. In some cases, the member 716 *a* may be formed from an elastic material and may be installed into the groove 618 using a press-fitting or compression operation.

FIG. 7B depicts an alternative tab 614*b* formed from a shell 702 and end cap 701*b*. In this example, the member 716*b* includes a tapered portion that is configured to engage a corresponding tapered groove formed in the end cap 701*b* of the tab 614*b*. The tapered portion along with other features of the member 716*b* may facilitate installation and retention of the member 716*b* in the groove of the end cap 701*b*. A variety of other groove geometries and ring geometries may be used to attach a member to a tab in a similar fashion to those described with respect to FIGS. 7A-B.

A friction-enhancing member may be attached to the tab using a variety of other techniques. For example, a member may be attached to the tab using an adhesive, threaded fastener, or other attachment technique. In some cases, the member may be attached to the tab using an over-molding process or similar technique. For example, the friction-enhancing member may be formed over at least a portion of the attachment surface of the tab.

Figure 8A:
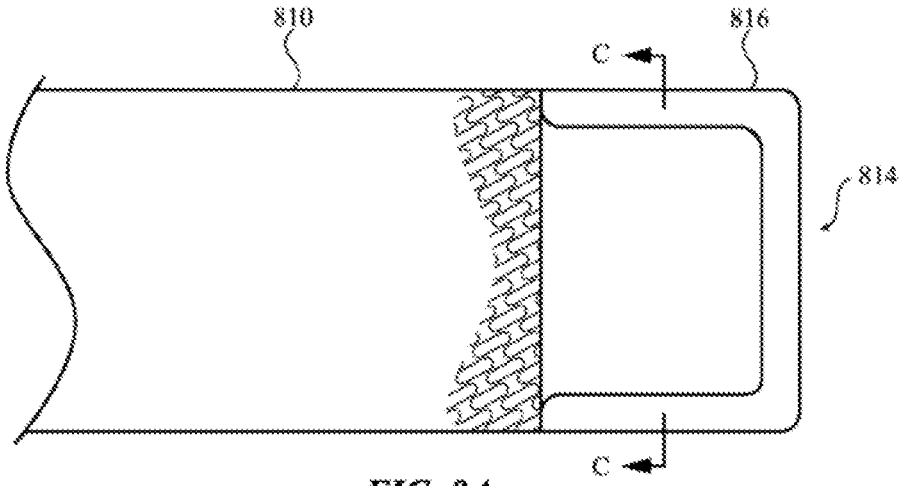
FIGS. 8A-B depict a detail view of an end of a band strap and an example tab having an alternative example of a friction-enhancing member.
Figure 8B:
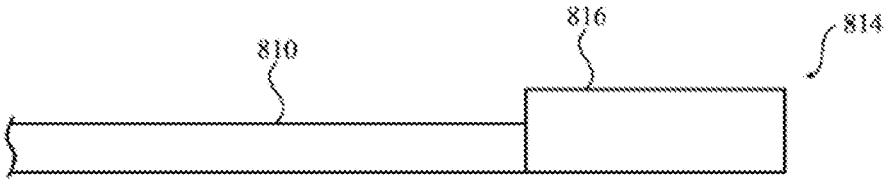

FIGS. 8A-B depict a detail view of an end of a band strap formed and an example tab having an alternative example of a friction-enhancing member. FIGS. 8A-B depict a top and side view, respectively, of a band strap 810 having a tab 814 attached to the free end of the strap. As shown in FIGS. 8A-B, a friction-enhancing member 816 may form at least a portion of the perimeter of the tab 814. In particular, the friction-enhancing member 816 may be formed around three sides of the tab 814 as shown in FIG. 8A. The member 816 may be formed, for example, by over-molding or insert molding the member around the tab. In some cases, the member 816 may be formed using an injection molding, casting, or other forming process directly onto the tab 814. In some cases, the member 816 is formed separately and then attached to the tab using an adhesive or other attachment technique.

Figure 8C:
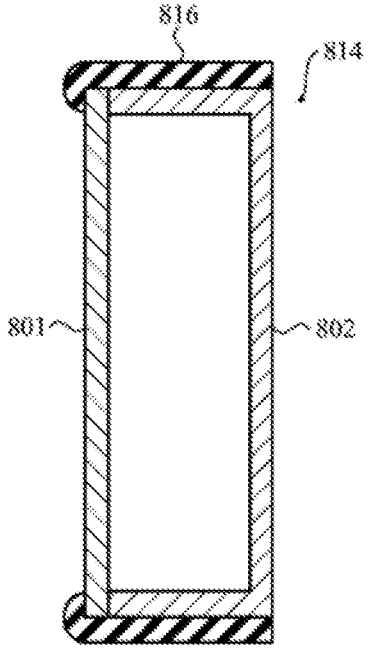
FIG. 8C depicts a cross sectional view of a tab having an alternative example of a friction-enhancing member taken along section C-C.

FIG. 8C depicts a cross sectional view of a tab having a friction-enhancing member taken along section C-C. FIG. 8C depicts one example configuration of the tab 814 being formed from a shell 802 and end cap 801 pieces. In other examples, the tab 814 may be formed from a single piece. As shown in FIG. 8C, the friction-enhancing member 816 is formed along the side of the tab 814 and protrudes slightly from the attachment surface of the tab 814. Similar to other member embodiments, the member 816 may be configured to increase the resistance to shear when the magnetic tab is attached to the surface of the first band strap. The additional advantage of the embodiment depicted in FIG. 8C may be that the member also protects the end of the tab and also improves the look and feel of the end of the band strap.

The friction-enhancing member 816 may be bonded to the side of the tab 814 using and adhesive or other attachment technique. In some cases, the member 816 may also be formed around the back surface of the tab 814. In this case, the member 816 may be attached to the tab 814 by a snap-fit or other similar type of mechanical engagement. In yet another example embodiment, the friction-enhancing member 816 also forms part or all of the shell 802 of the tab 814.

In the examples provided above, the tab is attached to the band strap, which is formed from a mesh material. As previously mentioned, using some traditional techniques, it may be challenging to form a strong and/or reliable joint between a mesh material and another component, such as a tab, coupling component, or other element of the band.

FIGS. 9A-F, 10A-C, 11, and 12A-C depict various techniques for joining a component to a metallic mesh material that may provide advantages over some traditional techniques.

Figure 9A:
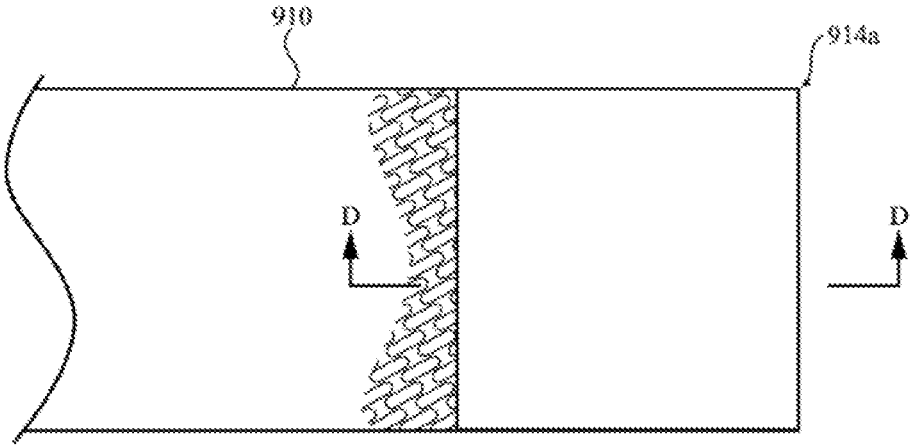
FIGS. 9A-F depict detail views of an end of a band formed from a metallic mesh material and various example tab attachment techniques.

FIG. 9A depicts a top view of a portion of a band strap 910 attached to a tab 914*a*. In the following examples, the band strap 910 is formed from a metallic mesh material. As discussed above, the metallic mesh may be formed from an array of interlocking links or, alternatively, a woven mesh of metallic threads. In some cases, the metallic mesh is a combination of links and woven meshes. The metallic mesh may also include non-metallic materials. The following examples are provided with respect to the attachment of a tab to a mesh material. However, similar techniques can be used to attach a variety of other components, including, for example, coupling components, loops, and other elements of the band.

Figure 9B:
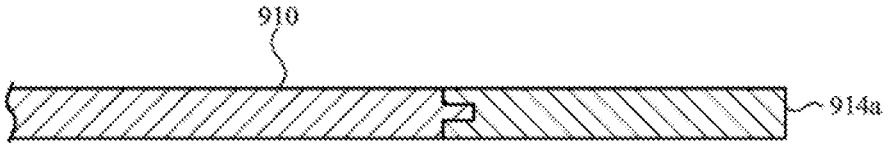

FIG. 9B depicts a cross-sectional view of a band strap 910 and tab 914*a* taken along section D-D. In the present example, an end of the band strap 910 is formed into a tongue feature having a protrusion that extends along the length of the end of the band strap 910. The tongue may be formed, for example, by compressing or forging the mesh material into a protrusion shape. In some cases, the tongue may also be formed using a machining or cutting process. The amount of machining that is performed may depend, in part, on the composition and type of mesh material that is used. In general, it may be advantageous to reduce the amount of material that is removed in order to preserve the structural integrity of the mesh material.

In the example depicted in FIG. 9B, the formed protrusion may be filled with a brazing material. In some cases, a braze or weld material, including, for example, copper, copper alloy, silver, nickel alloy, or other metallic materials may be melted and drawn into the mesh material by capillary action. The formed protrusion and braze material may form a solid section of material that is substantially free of open space or internal cavities. In some cases, the protrusion is further machined after filling with a brazing material to form the final shape of the tongue feature. The tongue formed into the end of the mesh material may then be inserted into a mating groove feature formed into an end of the tab 914*a*. The band strap 910 may then be permanently attached to the tab 914*a* using, for example, a mechanical fastener inserted into a thru hole that extends through both the tongue feature of the band strap 910 and the groove feature of the tab 914*a*. Additionally or alternatively, in some cases, a laser welding operation is used to fuse portions of the tongue feature to portions of the groove feature or other portion of the tab. In yet another alternative, the tongue feature is fused to the groove feature by heating the braze material and compressing the groove into the tongue of the band strap 910. In some embodiments, an adhesive or other bonding agent may be used to attach the tab 914*a* to the mesh material of the band strap 910.

Figure 9C:
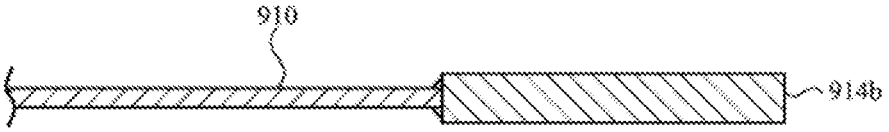

FIG. 9C depicts a cross-sectional view of a band strap 910 attached to tab 914*b* taken along section D-D. In the present example, an end of the band strap 910 is attached via a butt joint. In this example, the end of the band strap 910 is attached to the tab 914*b* via one or more filet welds extending along a portion of the seam between the band strap 910 and the tab 914*b*. The filet weld may be formed using a laser-welding or other precision welding technique. In some cases, a region of the mesh material near the end of the strap may be filled with a braze material to create a solid section of material that is substantially free of open space or internal cavities. In some cases, the brazed end of the strap is machined to form the final shape of the end of the strap. The brazed and machined portion of the mesh may facilitate a strong and reliable filet weld between the band strap 910 and the tab 914*b*.

Figure 9D:
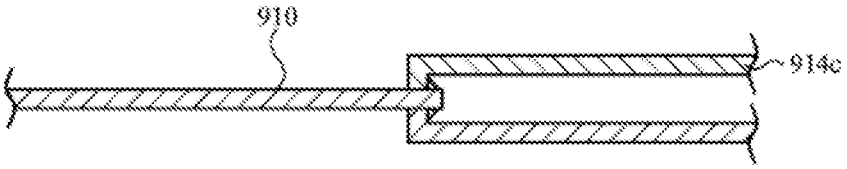

FIG. 9D depicts another cross-sectional view of the band strap 910 attached to tab 914*c* taken along section D-D. In the present example, an end of the band strap 910 is attached via a slotted joint. In this example, the end of the band strap 910 is inserted into a slot in the tab 914*c* and attached to the tab 914*c* via one or more filet welds. The filet welds may be located on the other side of the slot, as shown in FIG. 9D. Additionally or alternatively, the filet welds may be located on the outside of the slot or other areas where the band 910 and tab 914*c* meet. As with the previous example, the filet weld may be formed using a laser-welding or other precision welding technique. In some cases, a region of the mesh material near the end of the strap may be filled with a braze material to create a solid section of material that is substantially free of open space or internal cavities. In some cases, the brazed end of the strap is machined to form the final shape of the end of the strap. As discussed above, a brazed and machined portion of the mesh may facilitate a strong and reliable filet weld between the band 910 and the tab 914*c*.

Figure 9E:
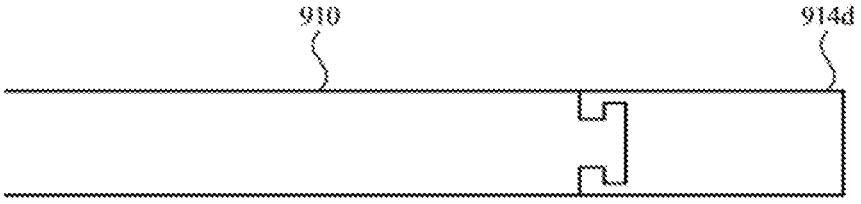

FIG. 9E depicts another cross sectional view of the band strap 910 attached to tab 914*d* taken along section D-D. In the present example, an end of the band strap 910 is attached via a T-shaped joint. In particular, a T-shaped protrusion is formed at the end of the band strap 910 which may be slid into a corresponding T-shaped groove formed into the tab 914*d*. One advantage of the attachment configuration of FIG. 9E is that a mechanical interlock is formed between the end of the band strap 910 and the tab 914*d*. That is, the T-shaped protrusion and T-shaped groove form a mechanical interlock that prevents the band strap 910 from pulling out of the mating groove in the tab 914*d* at least in a direction that corresponds to the length of the band strap 910. In some embodiments, an adhesive, solder material, braze material, or other bonding agent may be used to secure the tab 914*d* to the end of the band strap 910 when the two pieces are assembled together.

Figure 9F:
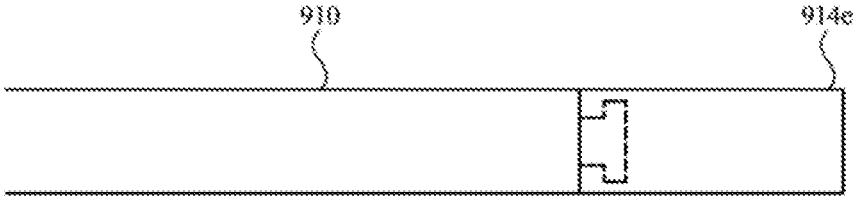

FIG. 9F depicts another cross-sectional view of the band strap 910 attached to tab 914*e* taken along section D-D. In the present example, an end of the band strap 910 is attached via a blind T-shaped joint. In particular, a T-shaped protrusion is formed at the end of the band strap 910 which may be inserted into a corresponding recess having an undercut formed into the tab 914*e*. Similar to the example of FIG. 9E, the attachment scheme of FIG. 9F may provide a mechanical interlock between the band strap 910 and the tab 914*e*. In addition, an adhesive, braze material, solder material, or other bonding agent may be used to secure the band strap 910 to the tab 914*e*. An additional advantage of the configuration depicted in FIG. 9F is that the joint may be hidden from view and a substantially smooth surface may be formed along the sides of the tab 914*e*. However, because the recess formed in the tab 914*e* is not open at the ends, the band strap 910 may not be slid into the recess from a lateral direction.

Figure 10A:
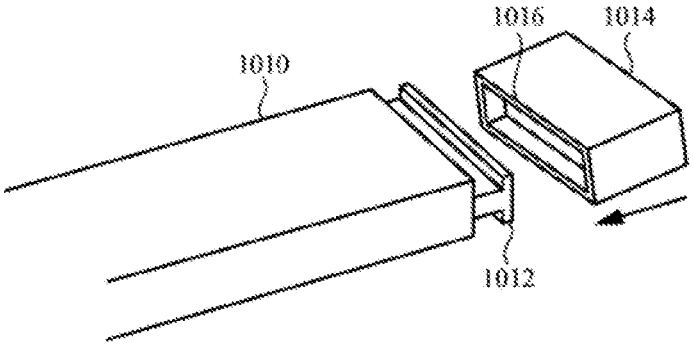
FIGS. 10A-C depict an example tab attachment sequence.
Figure 10B:
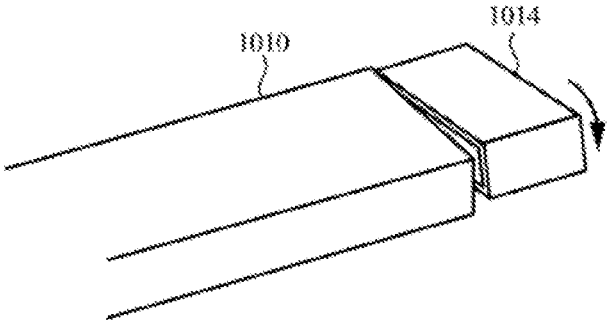
Figure 10C:
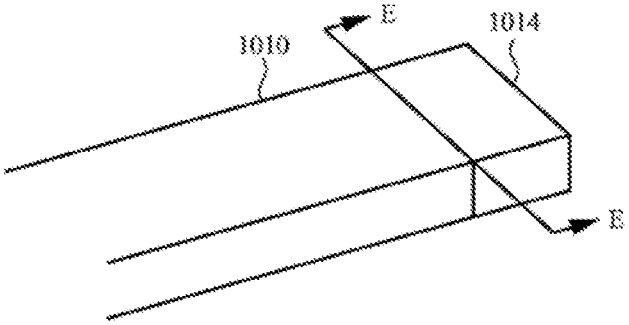

FIGS. 10A-C depict an example tab attachment sequence which may be used to attach a band strap 1010 to a tab 1014 having a blind recess 1016. The attachment sequence of FIGS. 10A-C may be used, for example, to attach the tab 914*e* to the band strap 910 described above with respect to FIG. 9F. In particular, the sequence of FIGS. 10A-C depict how a tab 1014 may be attached by rotating the tab 1014 with respect to a protrusion on the band strap 1010 (e.g., T-shaped protrusion 1012) to mechanically engage or interlock the two pieces.

As shown in FIG. 10A, the tab 1014 having a recess 1016 may be inserted over the protrusion 1012 of the band strap 1010 while the tab 1014 is at a slight angle with respect to the protrusion 1012. In the present example, the protrusion 1012 and/or the recess 1016 are formed at an angle with respect to a plane (e.g., a central plane) of the mesh of the band strap 1010 and/or the tab 1014. During the operation depicted in FIG. 10A, the protrusion 1012 and the recess 1016 (one or both of which are at an angle) are aligned with each other to enable the assembly of the two pieces. In some cases, prior to inserting the protrusion 1012 into the recess 1016, the recess 1016 is partially filled with a bonding agent. For example, an adhesive, solder material, or other bonding agent may be deposited on the bottom of the recess 1016 prior to assembly. The bonding agent may then be cured, reflowed, or baked after assembly to improve the strength of the joint between the two pieces.

As shown in FIG. 10B, the tab 1014 is rotated or twisted slightly with respect to the band strap 1010. In the present example, the tab 1014 is rotated to align one or more outer surfaces (e.g., the top surfaces) of the two parts. In some embodiments, the outer surfaces may not be co-planar, but may be substantially parallel. In some embodiments, a central plane of the mesh of the band strap 1010 is substantially aligned with a central plane of the tab 1014. In some implementations, the recess 1016 of the tab 1014 includes an undercut, which may be configured to receive the upper portion of the T-shaped protrusion 1012 as the tab 1014 is rotated. In this example, when the tab 1014 is rotated to be in alignment with the band strap 1010, the protrusion 1012 may mechanically engage the undercut formed in the recess 1016 creating a mechanical interlock between the tab 1014 and the band strap 1010.

FIG. 10C depicts the tab 1014 after rotation and in alignment with the band strap 1010. In this example, the top and bottom surfaces of the band strap 1010 and the tab 1014 are substantially aligned when the tab 1014 is twisted into place. However, because the band strap 1010 is formed from a metallic mesh, the band strap 1010 may not have a single continual surface, but instead a composite of many surfaces that are generally aligned along a common plane or curve. In some cases, the central plane of the end of the band strap 1010 may be generally parallel to the central plane of the tab 1014 when the two parts are assembled together as depicted in FIG. 10C. As previously mentioned, after the tab 1014 has been assembled to the band strap 1010, any bonding agent present in the joint may be cured, re-flowed, baked, or otherwise fixed to prevent the two pieces from becoming disassembled during use. In some cases, the combination of a mechanical interlock and a bonding agent provides an improved joint between the band strap 1010 and the tab 1014.

Figure 11:
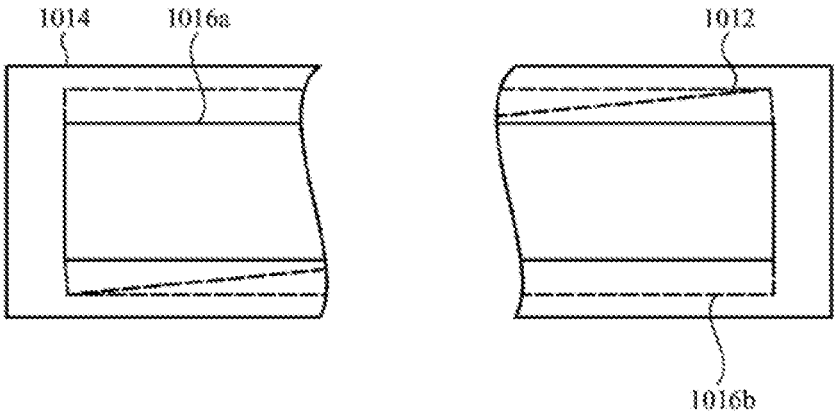
FIG. 11 depicts a cross sectional view of an example tab attachment.

FIG. 11 depicts a cross-sectional view of the example tab attachment of FIG. 10C taken along section E-E. As indicated in FIG. 11, the T-shaped protrusion 1012 is formed at an angle with respect to a plane of the band strap (item 1010 of FIGS. 10A-C). The recess of the tab 1014 includes an opening portion 1016*a* which is configured to receive the T-shaped protrusion 1012 when it is generally aligned with the opening portion 1016*a* (as shown, for example, in FIG. 10B). As shown in FIG. 11, the recess of the tab 1014 also includes an undercut portion 1016*b*, which is configured to receive the top portion of the T-shaped protrusion 1012 when the tab 1014 is twisted or rotated into position. As previously discussed, the undercut portion 1016*b* of the tab 1014 may mechanically engage the T-shaped protrusion 1012 when the tab 1014 is aligned with the band strap. For example, the two parts may mechanically engage when the central plane of the mesh of the band strap is substantially aligned with the central plane of the tab 1014.

As previously discussed, in some embodiments, the band strap 1010 may be bonded to the tab 1014 after the two parts have been mechanically interlocked or engaged. For example, in some embodiments, an adhesive, solder material, braze material, or other bonding agent may be injected or otherwise disposed within the recess 1016 and cured/baked to prevent the tab 1014 from being removed from the band strap 1010. In some cases, the band strap 1010 is welded to the tab 1014 after the two parts have been mechanically interlocked or engaged. For example, a weld may be formed along the seam between the band strap 1010 and the tab 1014 after the two parts have been assembled. In some cases, the mechanical interlock in combination with the adhesive bond or weld may provide a joint that has superior strength or durability as compared to a joint using only an adhesive or weld to secure the parts.

In the example of FIGS. 10A-C and 11, the T-shaped protrusion 1012 is formed at an angle with respect to a plane of the band strap 1010. However, in alternative embodiments, the recess and undercut formed in the tab may be formed at an angle. In some embodiments, both the protrusion at the end of the band strap and the recess formed in the tab may be formed at an angle with respect to a plane of the respective parts. Additionally, while the recess is formed into the tab 1014 in the present embodiment, in alternative embodiments, the recess may be formed into a portion of the mesh and the protrusion may be formed into the tab.

Figure 12A:
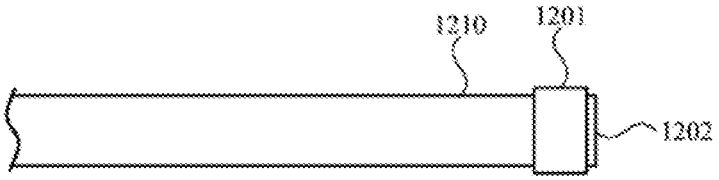
FIGS. 12A-C depict an example manufacturing sequence for a band formed from a metallic mesh material.
Figure 12B:
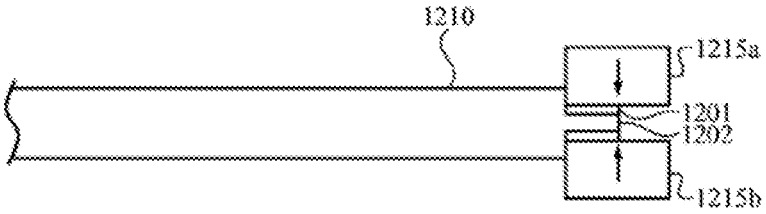
Figure 12C:
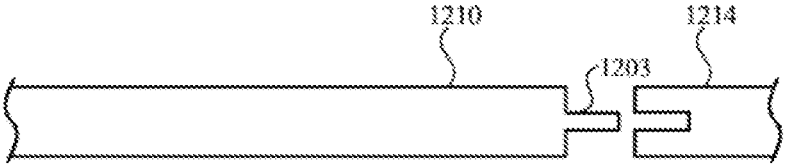

FIGS. 12A-C depict an example manufacturing sequence for forming a feature in the end of a mesh band. In this example, a compression sleeve is formed onto the end of the mesh band strap to facilitate attachment to another component, such as a tab or loop piece. While the technique described below may be used for a variety of mesh materials, the use of a compression sleeve may be particularly advantageous for meshes that are formed from interlocking loops of material.

As shown in FIG. 12A, a compression sleeve 1201 may be placed over the end 1202 of the band strap 1210. In some cases, the compression sleeve 1201 includes a rectangle-shaped aperture that is slightly larger than the end 1202 of the band strap 1210. The compression sleeve 1201 may be formed from a variety of metal or metal alloy materials. In some cases, the compression sleeve is formed from a relatively soft metal alloy, such as copper alloy, brass, silver alloy and the like. The compression sleeve 1201 may also include one or more features that facilitate compression. For example, the compression sleeve 1201 may include a notched or thin walled section that is configured to buckle or deform when the compression sleeve 1201 is compressed. This may provide more consistent compression for the operation described below with respect to FIG. 12B. In some cases, the compression sleeve may be formed from a foil or thin sheet material formed into a shape that is relatively easily deformed or compressed.

FIG. 12B depicts an example compression operation for forming a protrusion or tongue in the end 1202 of the band strap 1210. As shown in FIG. 12B, an upper mandrel 1215*a* and a lower mandrel 1215*b* may be brought together to compress the sleeve 1201 onto the end 1202 of the band strap 1210. The upper 1215*a* and lower 1215*b* mandrels may both move, or one may remain stationary during the forming process. The mandrels 1215*a*,

1215*b* may be brought together using a hydraulic or other high-pressure forming mechanism. Depending on the material properties of the sleeve 1201 and the end 1202, the pressing operation depicted in FIG.
12B may result in the sleeve material being fused with a portion of end 1202. In some cases, a laser welding operation is used to melt the sleeve material and facilitate fusion of the two components. In some cases, a brazing process is used to fill any remaining gaps or cavities in the end 1202 of the band.

As a result of the operation depicted in FIG. 12B, the end of the band may be formed into a solid section 1203 that is formed into a protrusion or tongue-shaped feature. For example, the solid section 1203 may be substantially free of open space or internal cavities. In some cases, the solid section 1203 is machined to form the final shape of the end of the end of the strap. As shown in FIG. 12C, the solid section 1203 may be inserted into a corresponding groove or feature of a mating part 1214. The band strap 1210 may then be attached to the mating part 1214 using a laser-welding or other mechanical joining technique. In some cases, a mechanical fastener, such as a screw or rivet, may be used to attach the band strap 1210 to the mating part 1214. In some cases, the compression sleeve technique described with respect to FIGS. 12A-C may facilitate a strong and reliable filet weld between the band strap 1210 and the mating part 1214.

In some embodiments, the mesh used to form the band strap is subjected to processing or operations that are configured to produce a band strap having the desired dimensions and physical qualities. For example, the mesh material may be rolled flat to decrease the thickness of the mesh. In cases where the mesh material is formed from an array of interlocking links, a rolling process may also lengthen or elongate the links, which may increase the flexibility of the mesh and allow it to bend around a smaller radius. In some embodiments, a rolling operation may facilitate the latching configuration described above in, for example, FIG.
2A. Additionally, in some implementations, the mesh may also be compacted or crushed along the width of the band. In one example, a crushing operation may be performed on a portion of band before or after it is subjected to a rolling or thinning operation.

Figure 13A:
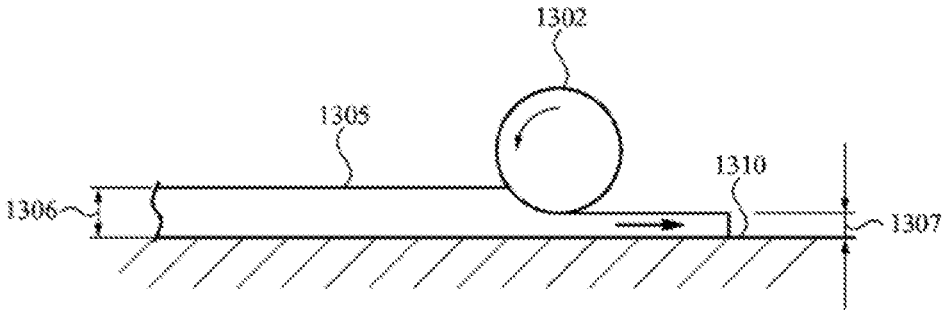
FIGS. 13A-B depict an example technique for manufacturing a band formed from a metallic mesh material.

FIG. 13A depicts on example process for using a roller to reduce the thickness of a mesh material. As shown in FIG. 13A, a portion of mesh 1305 may be fed into a roller 1302 disposed over a surface 1310, which compresses the mesh into a thinned portion having a reduced thickness 1307. The rolling process depicted in FIG. 13A may be repeated over multiple stages in order to achieve the final desired thickness of the mesh.

Figure 13B:
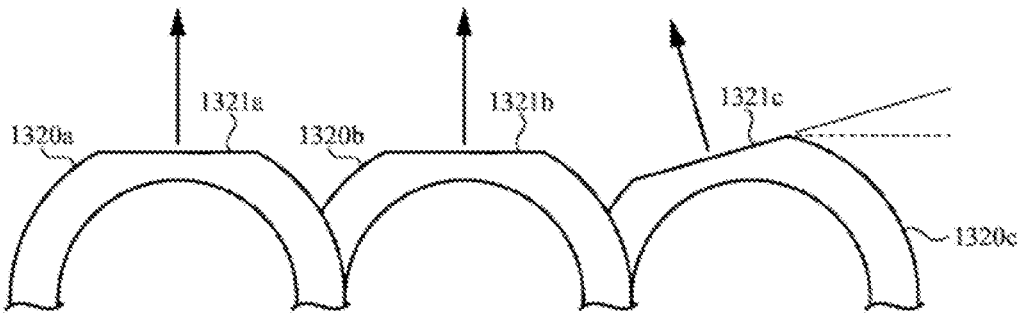

In some cases, the rolling process depicted in FIG. 13A results in the creation of multiple facets or flat surface along the mesh material. For example, if the mesh is formed from an array of interlocking links, the top surface of some of the links may be flattened by the rolling process. FIG. 13B depicts an example representation of three links 1320*a-c* having facets 1321*a-c* created by a rolling process. In some cases, facets may form individual mirror-like surfaces that reflect light, increasing the shimmer of the mesh. However, in some cases, the facets may be reflect light in an inconsistent manner, which may not be desirable in some implementations. For example, as shown in FIG. 13B, one or more facets (e.g., 1321*c*) may be out of alignment with the other facets (e.g., 1321*a-b*) resulting in light being reflected in different directions. The inconsistent light reflection may detract from an even appearance of the mesh and, therefore, may not produce the light reflecting properties desirable in some types of bands.

Figure 14A:
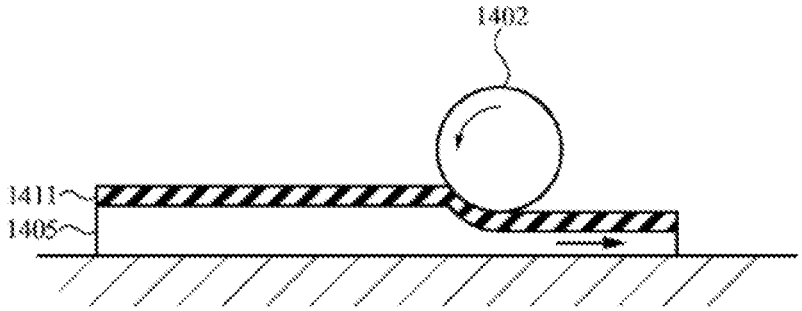
FIGS. 14A-C depict an example technique for manufacturing a band formed from a metallic mesh material using a compliant member.
Figure 14B:
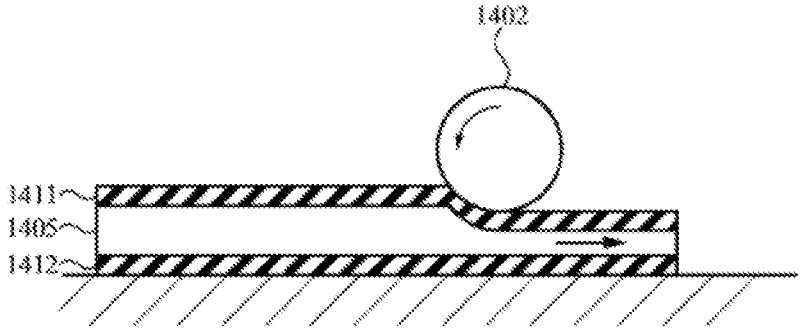
Figure 14C:
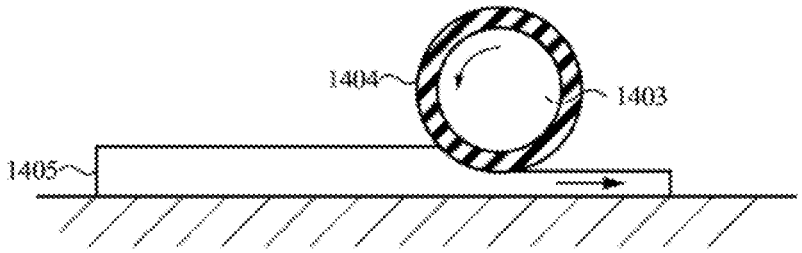

The creation of facets or flattened links may be minimized or reduced by using a compliant member when rolling the mesh material. FIGS. 14A-C depict an example technique for manufacturing a band formed from a metallic mesh material using a compliant member. For example, a compliant member may be disposed between the mesh material and the roller while the mesh is being flattened. In some cases, the compliant member distributes the load created by roller to a greater area of the mesh to reduce or eliminate faceting of the mesh. In some embodiments, the compliant member may have a hardness that is sufficient to transfer a load to mesh, flattening the material while also being elastic enough to prevent the formation of facets or flat surfaces as the mesh is being flattened. In some cases, the compliant member plastically deforms or yields during the rolling process, which may facilitate high-pressure rolling operations without creating facets or flat surfaces on the mesh. The compliant member may be formed from a variety of materials, including without limitation, polyethylene (PE), high-density polyethylene (HDPE), ultra-high molecular weight polyethylene (UHMW PE), nylon, and urethane materials.

FIG. 14A depicts one example embodiment of a rolling process. As shown in FIG. 14A, a compliant sheet 1411 is disposed between the mesh 1405 and the roller 1402 as the mesh is being thinned. In some cases, the compliant sheet 1411 is placed or disposed on the mesh 1405 before the rolling operation and may be temporarily fixed with respect to the mesh
1405 by an adhesive or mechanical attachment. In other cases, the compliant sheet 1411 may be fed between the roller 1402 and the mesh 1405 as the mesh 1405 is being fed under the roller
1402. In some cases, the compliant sheet 1411 is used only one time. This may be particularly true if the compliant sheet 1411 is deforms to yield during the rolling process.

FIG. 14B depicts an alternative embodiment of a rolling process that uses a compliant member. As shown in FIG. 14B, a top compliant sheet 1411 and a bottom compliant sheet 1412 may both be used during a rolling operation. In this example, a top sheet 1411 is disposed between an upper surface of the mesh 1405 and the roller 1402 during the rolling process. A second, bottom sheet 1412 is disposed between the mesh 1405 and a support or forming surface, which is opposite to the roller 1402. The embodiment depicted in FIG. 14B
may further reduce the formation of facets or flat surfaces on the bottom of the mesh 1405 as it is being formed.

FIG. 14C depicts another alternative embodiment of a rolling process that uses a compliant member. As shown in FIG. 14C, the compliant member 1404 may be formed over the surface of the roller 1403. Similar to the previous examples, when the mesh 1405 is being thinned, the compliant member 1404 will be disposed between the roller 1403 and the mesh 1405, which may reduce the occurrence of facets or flat surfaces on the mesh. In this example, it may be advantageous that the compliant member 1404 not deflect to yield so that it may be used continuously.

As previously mentioned, the mesh may be processed using multiple rolling operations to achieve the desired thickness and/or bend radius properties. The mesh may also be processed using one or more crushing operations that compact or crush the mesh material along the width of the strip (e.g., perpendicular to the rolled thickness). For example, the mesh may be placed width-wise between two mandrels or tools that are configured to apply substantial force along the edge of the mesh.

The crushing operation(s) may be used to maintain the desired width of the mesh in between rolling operations. The crushing operations may also help to maintain the orientation of the links and/or preserve the structural integrity of the mesh. In some example process flows, the mesh is rolled and then crushed in an alternating fashion until the final shape and/or desired properties are achieved. In one particular example, the mesh is rolled and then crushed three separate times to achieve the desired bend radius, although more or fewer rolling and crushing operations may be performed in various embodiments, and multiple rollings may be done per crushing or vice versa. In some cases, this process allows the mesh to achieve a bend radius that is superior or improved with respect to some other meshes having a comparable density.

For some mesh materials, multiple rolling and/or crushing processes may produce a warp or distortion in the links of the mesh material. In one example, the portion of the mesh near the middle of the mesh may experience greater expansion that portions of the mesh near the edges of the mesh. This may result in a bowed or curved pattern in the mesh material, which may not be desirable in the final product. To help reduce or alleviate uneven expansion, a sacrificial portion of the mesh may be formed at the end or ends of the mesh material. In one example, a sacrificial portion may be formed by crushing the length of the mesh, excluding the end portion or portions of the mesh; the excluded, uncrushed portion may be the sacrificial portion. The sacrificial portion(s) may prevent uneven expansion of the mesh and reduce the chance of warp or distortion due to multiple rolling and crushing operations. In some cases, the sacrificial portions of the mesh are cut away after the rolling and crushing processes are complete.

The mesh may also be placed in a fixture to facilitate handling and placement in a crushing press or similar forming tool. In one example embodiment, the mesh is located and retained using a fixture having at least one magnetic or magnetized face. The mesh may be clamped, for example between two plates, one of which includes a magnetized face. The magnetic fixture may allow the mesh to be positioned and held in a crushing press without the use of mechanical clamps or adhesives. This may be advantageous in reducing the stress or load that the fixture may place on the mesh during the crushing operation.

In some cases, the mesh may be further processed to produce the mechanical and optical properties that are desired in some mesh bands. For example, the ends of the mesh may be machined or formed to produce a particular mesh profile or edge finish. In some cases, a portion of the mesh material at the edges may be removed to produce a more square profile shape for the band. In some cases, material at the edge of the mesh may be removed to produce a particular shape formed by the links or elements of the mesh.

Figure 15A:
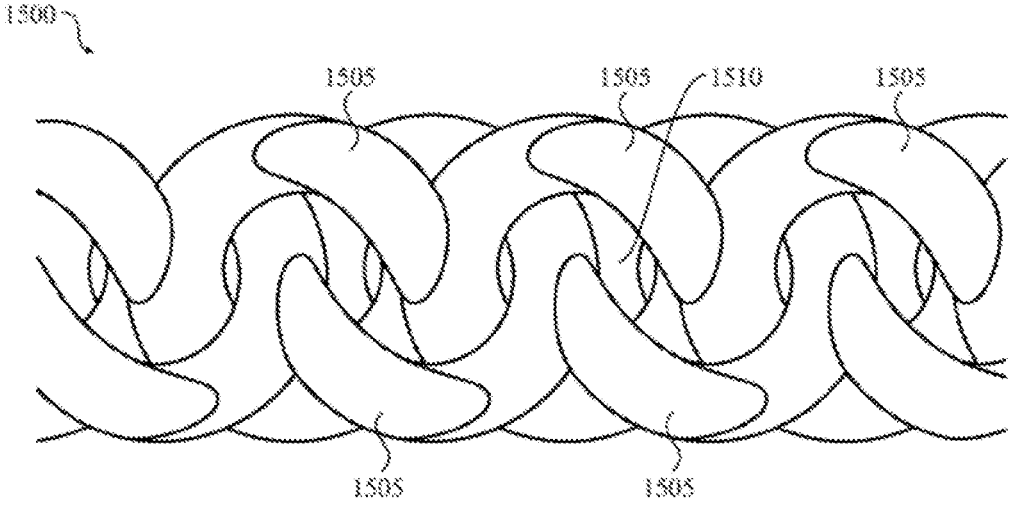
FIGS. 15A-B depict example edge finishes for a metallic mesh material.
Figure 15B:
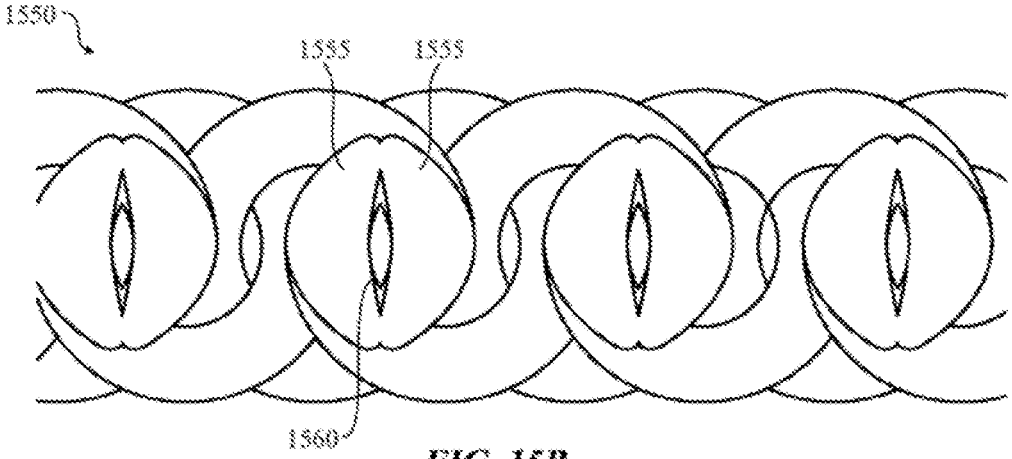

FIGS. 15A-B depict example edge finishes for a metallic mesh material. In the examples depicted in FIGS. 15A-B, the mesh is formed from an array of interlocking links or rings. Each link or ring may be formed to interlock with one or more adjacent links or rings resulting in a continuous mesh material. FIG. 15A depicts one example edge finish formed by removing a portion of the mesh 1500 to a specific depth. In this example, approximately one half of the link filament diameter is removed from the edge of the mesh. The mesh material may be removed using a grinding or machining process that is configured to produce a consistent and high quality finish. In some cases, additional surface polishing operations are performed on the edge of the mesh material after the material has been removed. As shown in FIG. 15A, the remaining links near the edge of the mesh 1500 form pairs of crescent features 1505. In some cases, this may also be described as a hurricane shape due to the nested orientation of the crescent features 1505.

In some cases, material is added to the small region 1510 of the mesh 1500 located between the crescent features 1505. For example, a laser welding operation may be used to deposit a bead or portion of material in the region 1510 located between a pair of crescent features 1505. In some embodiments, the edge of the mesh 1500 is lapped or polished again after the additional material is added to regions 1510. The resulting mesh 1500 may have a more consistent profile shape and refined look, as compared to other untreated mesh bands.

FIG. 15B depicts another example edge finish for a mesh material. Similar to the example provided above, material along the edge of the mesh 1550 may be removed to produce a particular pattern or shape. As shown in FIG. 15B, pairs of crescent features 1555 may be formed into the edge of the mesh 1550 if the mesh is machined or ground to a greater depth than the example provided above with respect to FIG. 15A. In the present example, approximately three quarters of the link filament diameter are removed. In some cases, the resulting pattern may also produce a step-like shape along the top and bottom edge of the mesh. In some cases, the step-like shape resembles a rampart or similar profile. Also, similar to the example provided above, the regions 1560 between the crescent features 1555 may be filled with additional material. As in the previous example, material may be added using a laser-welding process and the edge may be subjected to further finishing or polishing to achieve the desired effect. In particular, portions of the top and bottom edges of the mesh may be filled using a laser-welding process.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in procedures differently in various embodiments of the disclosure or described with different terminology. These and other variations, modifications, additions, and improvements may fall within the scope of the disclosure as defined in the claims that follow.

We claim:

1. A watch band comprising:

a band strap comprising:

a protrusion forming an end of the band strap;

a top band strap surface; and a bottom band strap surface;

a loop defining a hole for receiving the band strap; and a magnetic tab comprising:

a top magnetic tab surface;

a bottom magnetic tab surface;

a magnet configured to magnetically couple to the band strap; and a recess having an undercut portion, wherein, when the protrusion is twisted within the recess, the protrusion of the band strap is configured to mechanically engage the undercut portion to attach the band strap to the magnetic tab, the top band strap surface is aligned with the top magnetic tab surface, and the bottom band strap surface is aligned with the bottom magnetic tab surface.

2. The watch band of claim 1, wherein the protrusion is formed at an angle with respect to a central plane of the band strap.

3. The watch band of claim 2, wherein:

during assembly, the protrusion is received by the recess when the protrusion is aligned with an opening portion of the recess; and after assembly, the protrusion is configured to mechanically engage the undercut portion of the recess when rotated.

4. The watch band of claim 1, wherein:

the band strap is formed from a metallic mesh of interlocking links; and a portion of an edge of the band strap has been removed to create a substantially flattened surface.

5. The watch band of claim 4, wherein multiple pairs of crescent features are formed by a portion of the interlocking links that have been substantially flattened.

6. The watch band of claim 1, wherein:

the recess of the magnetic tab defines a groove feature formed along an edge of the magnetic tab;

the protrusion of the band strap defines a tongue feature formed in the end of the band strap; and the tongue feature of the band strap is mechanically engaged with the groove feature of the magnetic tab.

7. The watch band of claim 6, wherein:

the tongue feature is formed by compressing the end of the band strap to form a compressed portion, and the compressed portion is filled with a braze material to form a solid section.

8. The watch band of claim 1, wherein the magnetic tab further comprises:

an attachment face;

a friction-enhancing member disposed within a groove formed into the attachment face and configured to provide a resistance to shear when the magnetic tab is attached to a surface of the band strap.

9. The watch band of claim 8, wherein the loop and the band strap are each configured to attach to a body of a watch, the watch band is configured to secure the body against a wrist of a user, and the magnet is configured to magnetically couple to the band strap at one of multiple positions to provide one of a variety of tightness configurations about the wrist.

10. The watch band of claim 8, wherein the friction-enhancing member forms a ring disposed in the groove.

11. The watch band of claim 8, wherein the magnetic tab further comprises a shunt element adjacent to the magnet and opposite to the attachment face, the shunt element configured to shape a magnetic field of the magnet.

12. A watch band comprising:

a band strap comprising a protrusion forming an end of the band strap;

a loop defining a hole for receiving the band strap; and a magnetic tab comprising a magnet configured to magnetically couple to the band strap and a recess having an undercut portion, wherein:

the recess is configured to receive the protrusion while the magnetic tab forms a first angle with respect to the end of the band strap; and the protrusion is configured to be secured within the recess while the magnetic tab forms a second angle with respect to the end of the band strap.

13. The watch band of claim 12, wherein:

the recess of the magnetic tab defines a groove feature formed along an edge of the magnetic tab;

the protrusion of the band strap defines a tongue feature formed in the end of the band strap; and the tongue feature of the band strap is mechanically engaged with the groove feature of the magnetic tab.

14. The watch band of claim 12, wherein the protrusion is a T-shaped protrusion.

15. The watch band of claim 12, wherein the band strap further comprises a mesh of interlocking links.

16. A watch band comprising:

a band strap comprising:

a mesh of interlocking links; and a protrusion forming an end of the band strap;

a tab configured to couple to the band strap, the tab comprising a recess having an undercut portion, wherein the protrusion of the band strap is configured to mechanically engage the undercut portion to attach the band strap to the tab; and an adhesive within the recess and bonding the tab to the band strap.

17. The watch band of claim 16, wherein the tab is a magnetic tab configured to magnetically couple to the band strap.

18. The watch band of claim 16, wherein the protrusion is a T-shaped protrusion.

19. The watch band of claim 16, wherein:

during assembly, the protrusion is received by the recess when the protrusion is aligned with an opening portion of the recess; and after assembly, the protrusion is configured to mechanically engage the undercut portion of the recess when rotated.

20. The watch band of claim 16, wherein:

the magnetic tab includes a groove feature formed along an edge of the magnetic tab;

the band strap includes a tongue feature formed in the end of the band strap; and the tongue feature of the band strap is mechanically engaged with the groove feature of the magnetic tab.

* * * * *